US008523310B2

(12) United States Patent
Uchida

(10) Patent No.: US 8,523,310 B2
(45) Date of Patent: Sep. 3, 2013

(54) PRINTING APPARATUS AND PRINTING METHOD

(75) Inventor: Naoki Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 961 days.

(21) Appl. No.: 12/281,105

(22) PCT Filed: Feb. 28, 2007

(86) PCT No.: PCT/JP2007/053755

§ 371 (c)(1),
(2), (4) Date: Nov. 21, 2008

(87) PCT Pub. No.: WO2007/102364

PCT Pub. Date: Sep. 13, 2007

(65) Prior Publication Data

US 2009/0237437 A1 Sep. 24, 2009

(30) Foreign Application Priority Data

Mar. 2, 2006 (JP) ..... 2006-056899
Feb. 27, 2007 (JP) ..... 2007-047886

(51) Int. Cl.
*B41J 29/393* (2006.01)

(52) U.S. Cl.
USPC ..... 347/16; 347/19

(58) Field of Classification Search
USPC ..... 347/16, 19
See application file for complete search history.

(56) References Cited

U.S. PATENT DOCUMENTS 5,529,414 A 6/1996 Katano et al.
6,101,426 A 8/2000 Kimura et al.
6,116,795 A 9/2000 Ogasawara
6,371,609 B1 * 4/2002 Oikawa ..... 347/19
6,520,700 B1 2/2003 Iwata
6,769,759 B2 8/2004 Yamasaki et al.
2004/0061767 A1 * 4/2004 Yamada ..... 347/215

FOREIGN PATENT DOCUMENTS

JP 7-9715 1/1995
JP 8-25735 1/1996
JP 8-118754 5/1996
JP 11-49399 2/1999
JP 2000-95386 4/2000
JP 2001-180057 7/2001
JP 2003-11344 1/2003

OTHER PUBLICATIONS

English translation of International Preliminary Report on Patentability, International Application No. PCT/JP2007/053755, filed on Feb. 28, 2007.

* cited by examiner

*Primary Examiner* — Julian Huffman
(74) *Attorney, Agent, or Firm* — Fitzpatrick, Cella, Harper & Scinto

(57) ABSTRACT

In order to provide technique which reduce the positional shift of recording in the conveyance direction of a printing medium, a printing apparatus comprises: a conveyance unit for conveying the printing medium by rotating a roller; a detection unit for detecting a conveyance amount of a printing medium conveyed by rotating the roller in less than one rotation; an acquisition unit for acquiring a conveyance amount of the printing medium corresponding to a predetermined rotation amount of the roller by detecting the conveyance amount a plurality of times; and a setting unit for setting a rotation amount of the roller when forming an image on the printing medium based on a conveyance amount of a printing medium corresponding to the acquired predetermined rotation amount of the roller.

8 Claims, 26 Drawing Sheets

WHEN ROLLER IS PERFECT CIRCLE

WHEN ROLLER IS ODD-SHAPED

WHEN AREA FACTOR IS 100%

WHEN AREA FACTOR IS NOT 100%

2-PART SPLIT

8-PART SPLIT

PRINTING APPARATUS AND PRINTING METHOD

TECHNICAL FIELD

The present invention relates to a technique for controlling image forming position of a printing apparatus. More particularly, it relates to control of a conveying roller which conveys a printing medium.

BACKGROUND ART

An image forming apparatus of an ink jet type records on a printing medium by discharging ink from a print head during reciprocating motion in a main scanning direction. It forms an image by repeated recording in the main scanning direction while conveying the printing medium in a sub-scanning direction by means of a conveying roller. Generally, when conveying a printing medium, such as paper, on a conveying roller and the like, there are variations in the amount of conveyance (feed rate) depending on the mounting condition of the conveying roller, type of printing medium, and the like. Thus, patent document 1 discloses a technique for determining a correction value for the amount of conveyance based on printing results of a plurality of test patterns recorded using different correction values. That is, this technique selects the pattern which gives the best printing result from among the recorded test patterns and thereby determines a parameter for use to drive the conveying roller.

(Patent document 1) Japanese Patent Laid-Open No. 2003-011344

DISCLOSURE OF INVENTION

Problems it to be Solved by the Invention

However, the technique disclosed in the above document poses the following problems if there are variations in the amount of conveyance within one roller rotation (one cycle). One of the problems is that in order for the correction value that depends on the phase of the conveyance roller during execution of an adjustment operation to be set, a different correction value is determined each time the adjustment operation is executed, the result being that a stable image quality cannot be realized. Another problem is that this technique is incapable of correcting image forming irregularities known as white streaks and black streaks caused by variations during one roller rotation.

Variations in the feed rate caused by variations in roller profile, flexure of the roller, mounting of a roller support member, and the like with a period equal to one rotation of the roller have been negligible in conventional recording resolution. However, with recent improvement in recording resolution, the effect of feed rate variations with a period equal to one rotation of the roller has increased so much in a relative manner that the variations can no longer be ignored. Consequently, conveying control with a higher accuracy is required.

Naturally, with the improvement in recording resolution, machine accuracy has also been improved to ensure recording quality. However, it is technically difficult to increase machine accuracy to the extent that the effect of the feed rate variations with a period equal to one rotation of the roller will be negligible and it is not desirable in terms of cost performance.

The present invention has been made in view of the above problems and has an object to provide a technique which can reduce misregistration in a conveying direction of a printing medium.

Means for Solving the Problems

To achieve the above object, the present invention is configured as follows.

According to one aspect of the present invention, a printing apparatus which prints an image on a printing medium using a print head which discharges ink, the printing apparatus comprises: a conveyance unit for conveying the printing medium by rotating a roller; a detection unit for detecting a conveyance amount of a printing medium conveyed by rotating the roller in less than one rotation; an acquisition unit for acquiring a conveyance amount of the printing medium corresponding to a predetermined rotation amount of the roller by detecting the conveyance amount a plurality of times; and a setting unit for setting a rotation amount of the roller when forming an image on the printing medium based on a conveyance amount of a printing medium corresponding to the acquired predetermined rotation amount of the roller.

According to another aspect of the present invention, a printing method for a printing apparatus which has a print head which discharges ink, a conveyance unit which conveys a printing medium by rolling a roller, the printing apparatus prints an image on the printing medium using the print head, the printing method comprises: the detection step of detecting a conveyance amount of a printing medium conveyed by rotating the roller in less than one revolution; and the setting step of acquiring a conveyance amount of the printing medium corresponding to a predetermined rotation amount of the roller by detecting the conveyance amount a plurality of times, and setting a rotation amount of the roller when an image is formed on the printing medium based on an acquired conveyance amount of a printing medium.

Further features of the present invention will become apparent from the following description of exemplary embodiments (with reference to the attached drawings).

Effects of the Invention

The present invention can provide a technique which can reduce misregistration in the conveying direction of a printing medium.

BRIEF DESCRIPTION OF DRAWINGS

FIG. 20 is a diagram showing detected amounts of displacement when there is no fluctuation in the amount of variation due to paper slippage or the like;

BEST MODE FOR CARRYING OUT THE INVENTION

Preferred embodiments of the present invention will be described in detail below in an exemplary manner with reference to the drawings. However, components of the embodiments are strictly exemplary and are not intended to limit the scope of the present invention.

In the embodiments described below, a recording apparatus which uses a print head of an ink jet type will be taken as an example. The term "record" (or "print") herein not only means forming meaningful information such as characters or images, but also broadly means forming images, patterns, and the like on a printing medium or processing a printing medium regardless of whether the information is meaningful or meaningless or whether the information is visible to human vision.

Also, the term "printing medium" means not only paper used on typical recording apparatus, but also broadly means something that can receive ink, such as cloth, plastic film, metal plates, glass, ceramics, wood, and leather.

Furthermore, the term "ink" (also referred to as "liquid") should be interpreted broadly as is the case with the term "record" (or "print"). That is, it means a liquid which may be used to form images, patterns and the like or to process a printing medium, or to process ink when applied to a printing medium. The phrase "process ink" means the process of solidifying or insolubilizing coloring material in the ink applied to the printing medium, for example.

Besides, the term "nozzle" refers collectively to discharge ports, flow paths connected to them, and elements which generate energy used to discharge ink unless otherwise specified.

(First Embodiment)

A first embodiment of an image forming apparatus according to the present invention will be described below by taking a color ink jet printer as an example.

<Equipment Configuration>

Figure 1:
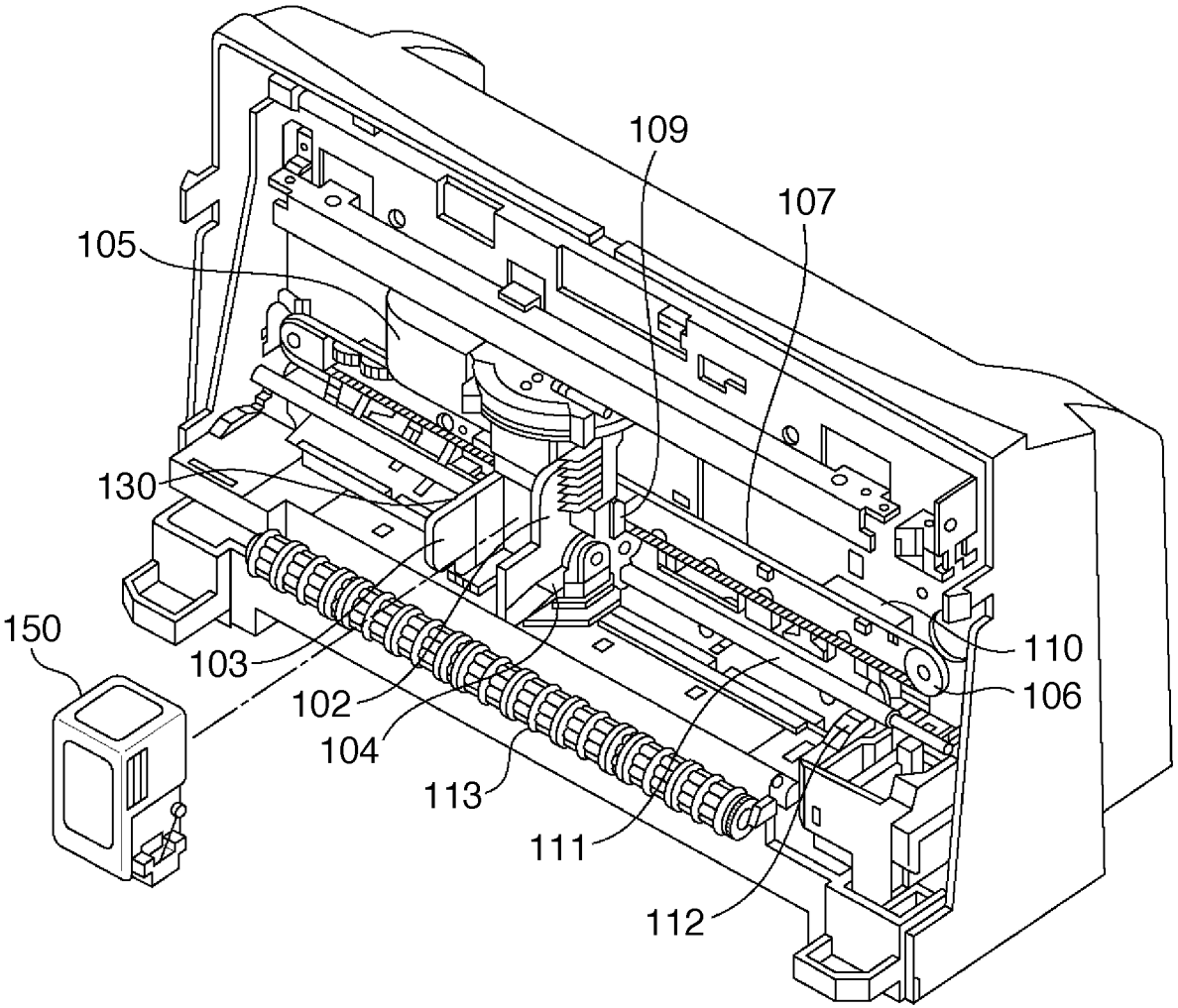
FIG. 1 is an external perspective view of a color ink jet printer according to a first embodiment.

FIG. 1 is an external perspective view of a color ink jet printer according to a first embodiment. Incidentally, a front cover has been removed in FIG. 1 to reveal an interior of the apparatus.

In FIG. 1, reference numeral 150 denotes a replaceable ink jet cartridge and 102 refers to a carriage unit which detachably holds the ink jet cartridge. Reference numeral 103 denotes a holder used to secure the ink jet cartridge 150 to the carriage unit 102. A cartridge lock lever 104, when operated after the ink jet cartridge 150 is mounted in the carriage unit 102, brings the ink jet cartridge 150 into press contact with the carriage unit 102. Consequently, the ink jet cartridge 150 is positioned and an electrical contact installed on the side of the carriage unit 102 to transmit necessary signals is brought into contact with an electrical contact on the side of the ink jet cartridge 150. Reference numeral 105 denotes a flexible cable used to transmit electrical signals to the carriage unit 102. Reference numeral 130 denotes a reflective optical sensor installed on the carriage unit 102. The reflective optical sensor 130 functions to detect density of adjustment patterns recorded and formed on paper during an automatic registration adjustment according to this embodiment. By combining carriage scanning (in a main scanning direction) and paper conveyance (in a sub-scanning direction), the reflective optical sensor 130 can freely detect density of the adjustment patterns formed on paper. Incidentally, the reflective optical sensor 130 may be used to detect ends of the paper.

Reference numeral 106 denotes a pulley which rotates when receiving power from a carriage motor as a drive source for causing round-trip scanning of a carriage unit 102 in a main scanning direction. Reference numeral 107 denotes a carriage belt which transmits motor drive power received through contact with the pulley to the carriage unit 102. Reference numeral 111 denotes a guide shaft located in the main scanning direction to support the carriage unit 102 and guide its movement. Reference numeral 109 denotes a transmissive photocoupler mounted on the carriage unit 102, and 110 denotes a light shielding plate installed near a carriage home position. Reference numeral 112 denotes a home position unit (also called a recovery unit) including a cap member which caps the front face of an ink jet head and a suction unit which sucks ink by creating negative pressure in this cap, and further including a recovery system such as a member which wipes the front face of a head.

Reference numeral 113 denotes an ejection roller used to eject the printing medium such as paper. It sandwiches the printing medium in cooperation with a spur roller (not shown) and ejects it out of the printer. In addition, there is a line feed unit which delivers a printing medium by a predetermined amount in a sub-scan direction.

Figure 2A:
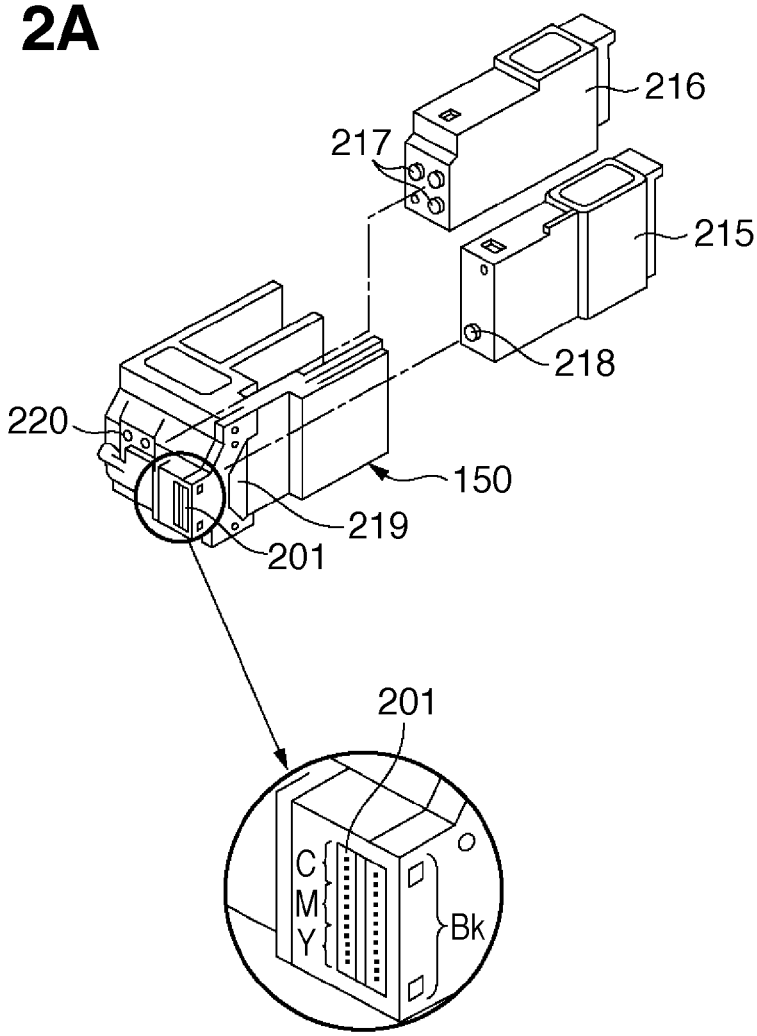
FIG. 2A is a perspective view illustrating a structure of an ink jet cartridge 150.
Figure 2B:
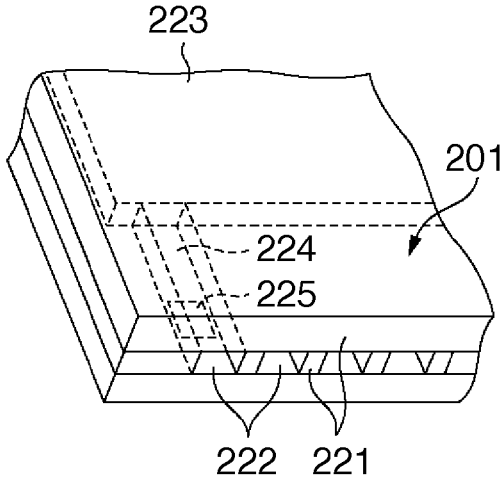
FIG. 2B is a perspective view illustrating a structure of an ink jet cartridge 150.

FIGS. 2A and 2B are perspective views illustrating a structure of the ink jet cartridge 150, where FIG. 2A is an exploded perspective view of the cartridge 150 and FIG. 2B is a schematic diagram showing a structure of the essence of a print head in the cartridge 150.

In FIG. 2A, reference numeral 215 denotes an ink tank containing black (Bk) ink and 216 denotes an ink tank containing cyan (C), magenta (M), and yellow (Y) inks. The ink tanks are detachable from the body of the ink jet cartridge. Reference numeral 217 denotes connection ports for the color inks contained in the ink tank 216: they are to be connected with ink supply pipes 220 on the side of the ink jet cartridge body. Reference numeral 218 similarly denotes a connection port for the black ink contained in the ink tank 215. The connection ports, when connected, allow the inks to be supplied to the print head 201 held in the ink jet cartridge body. Reference numeral 219 denotes an electrical contact which comes into contact with an electrical contact installed on the carriage unit 102. The electrical contacts, when brought into contact, allow electrical signals to be received from a console on the printer body via the flexible cable 105.

The print head 201 has a Bk-ink discharge unit consisting of an array of nozzles which discharge Bk ink as well as nozzle groups which respectively discharge Y, M, and C inks. The nozzle groups are arranged in line integrally composing a color-ink discharge unit. They are installed in the same range as Bk-ink discharge ports.

Discharge ports 222 are formed at a predetermined pitch on a discharge port surface 221 which faces a printing medium 108 such as paper with a predetermined clearance (e.g., approximately 0.5 to 2.0 mm). Also, electrothermal transducers (such as heaters) for generating energy used in ink discharge are installed along the wall of each flow path 224 connecting each of the discharge ports 222 with a common ink chamber 223.

Further, a cartridge 150 is mounted to a cartridge unit 102 in positions such that the plurality of discharge ports 222 will intersect a scanning direction of the carriage unit 102. Appropriate electrothermal transducers (hereinafter referred to as "discharge heaters") 225 are driven based on an image signal or discharge signal inputted via the electrical contact 219. Specifically, the inks in the flow paths 224 are caused to undergo film boiling and the inks are discharged through the discharge ports 222 under the pressure of generated bubbles.

Figure 3:
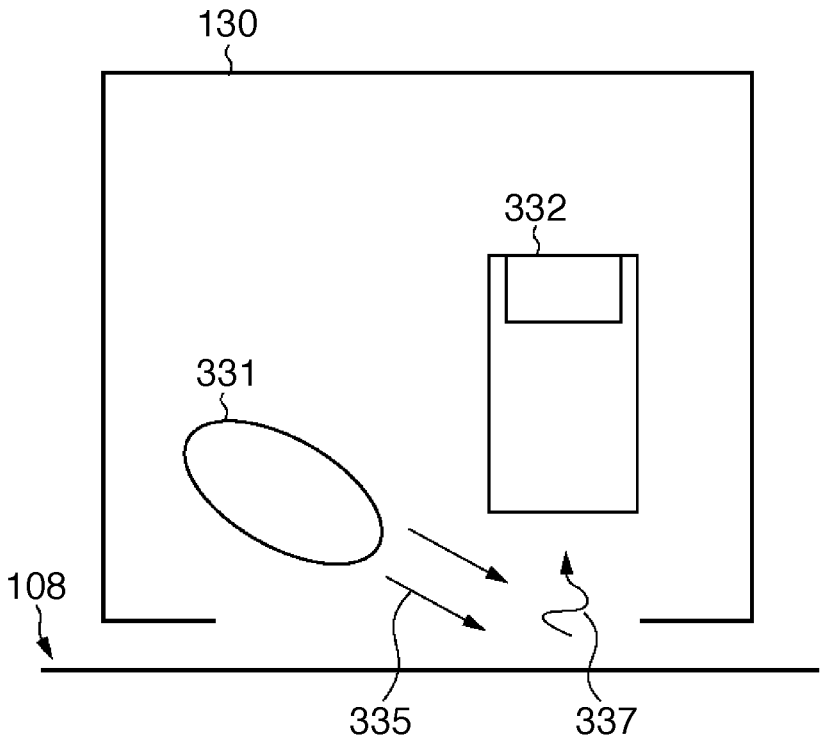
FIG. 3 is a schematic diagram illustrating a reflective optical sensor 130.

FIG. 3 is a schematic diagram illustrating the reflective optical sensor 130.

The reflective optical sensor 130 has a light-emitting unit 331 and light-receiving unit 332. Light Iin 335 emitted from the light-emitting unit 331 is reflected by a surface of the printing medium 108. Reflected light includes regularly reflected light and irregularly reflected light. To detect density of an image formed on the printing medium 108 more accurately, it is desirable to detect irregularly reflected light Iref 337. For this reason, the light-receiving unit 332 is placed such that it receives reflected light at an angle different from an incident angle of light from the light-emitting unit 331 so as to detect scattered reflection in this embodiment. A detection signal resulting from the detection is transmitted to an electrical circuit board of the printer.

It is assumed here that a white LED or three-colored LED is used as the light-emitting unit and photodiode sensitive to a visible-light region is used as the light-receiving unit to make registration adjustments for all the head which discharge C, M, Y, or K inks. However, it is preferable to use a three-colored LED capable of selecting colors which have high detectivity if adjustments are made among different colors when detecting relationship between relative recording position and density of colors printed one over another.

Incidentally, in detecting the density of an image formed on the printing medium 108, it is only necessary to detect a relative value rather than the absolute value of the density although details will be described later. Also, it is only necessary to have detection resolution enough to detect relative density differences among individual patterns belonging to an adjustment pattern group described later (hereinafter each pattern among adjustment patterns will be referred to as a patch).

Regarding stability of a detection system including the reflective optical sensor 130, it is sufficient if detected density differences are not affected during detection of one adjustment pattern group. Sensitivity is adjusted, for example, by moving the reflective optical sensor 130 to a margin of the printing medium. A possible adjustment method involves adjusting emission intensity of the light-emitting unit 331 or gain of detection amplifier of the light-receiving unit 332 such that a detection level will reach an upper limit. Incidentally, sensitivity adjustment is not essential, but it is a suitable method for improving an S/N ratio and increasing detection accuracy.

Figure 4:
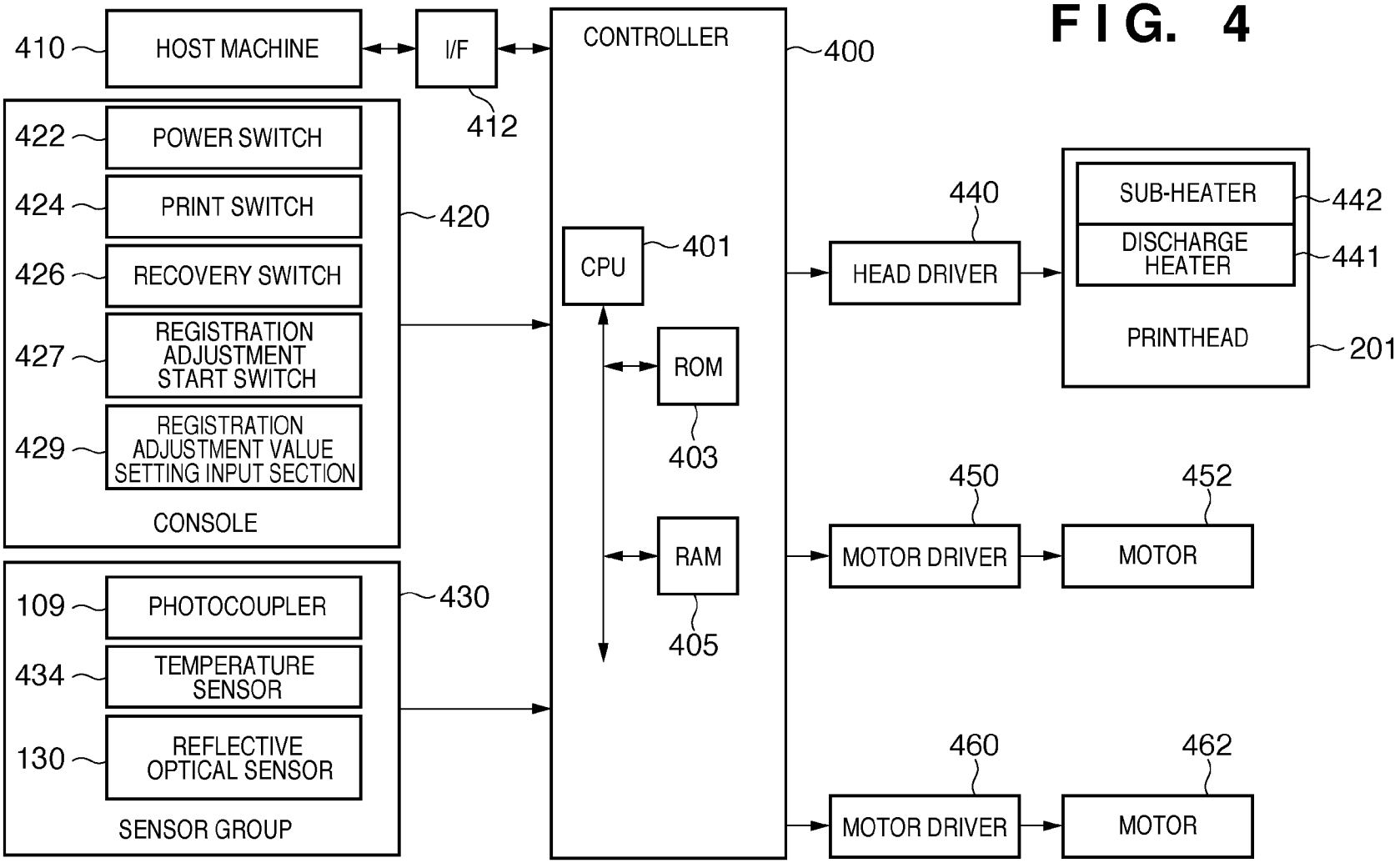
FIG. 4 is a schematic block diagram of a control circuit of the color ink jet printer according to the first embodiment.

FIG. 4 is a schematic block diagram of a control circuit of the color ink jet printer according to the first embodiment.

A controller 400 is a main control unit. It has a CPU 401 in the form of, for example, a microcomputer; ROM 403 which stores programs, required tables, and other fixed data; and RAM 405 with an area for use to load image data, work area, and the like. A host machine 410 is a source of image data. Specifically, it may be a computer which creates or processes images and other data related to printing, a reader which reads images, or the like. Image data, commands, status signals, and the like are transmitted and received to/from the controller 400 via an interface (I/F) 412.

A console 420 is constituted of a switch group which accepts commands from a user. It includes, a power switch 422, switch 424 used to start printing, and recovery switch 426 used to start suction recovery. It also includes a registration adjustment start switch 427 for manual registration adjustment and registration adjustment value setting input section 429 for use to enter adjustment values manually.

A sensor group 430 is used to detect condition of the apparatus. It consists of the reflective optical sensor 130, the photocoupler 109 used to detect the home position, a temperature sensor 434 mounted at an appropriate location to detect ambient temperature, and the like.

A head driver 440 is used to drive a discharge heater 441 in the print head 201 according to print data and the like. The head driver 440 has a shift register which align print data along the discharge heater 441 and a latch circuit which latches with an appropriate timing. Also, the head driver 440 has a logic circuit element which operates the discharge heater 441 in sync with a drive timing signal, timing setting unit which appropriately sets a drive timing (discharge timing) for dot formation/alignment, and the like.

The print head 201 is equipped with a sub-heater 442. The sub-heater 442 is used for temperature adjustment in order to stabilize ink discharge characteristics. It may be formed on the print head substrate simultaneously with the discharge heater 441 and/or mounted on the print head body or head cartridge.

A motor driver 450 drives a main scanning motor 452. A sub-scanning motor 462 is used to convey (sub-scan) the printing medium 108 and driven by a motor driver 460.

<Variations in Amount of Conveyance of Printing Medium by Conveying Roller>

Normally, a printing medium such as paper is conveyed through rotation of a conveying roller (hereinafter referred to as a "roller"). For example, if the roller is 47 mm in circumference, the printing medium is conveyed 47 mm by one rotation of the roller. Generally, however, there is slight deviation in the amount of conveyance when a printing medium is conveyed by a conveying roller.

Figure 5:
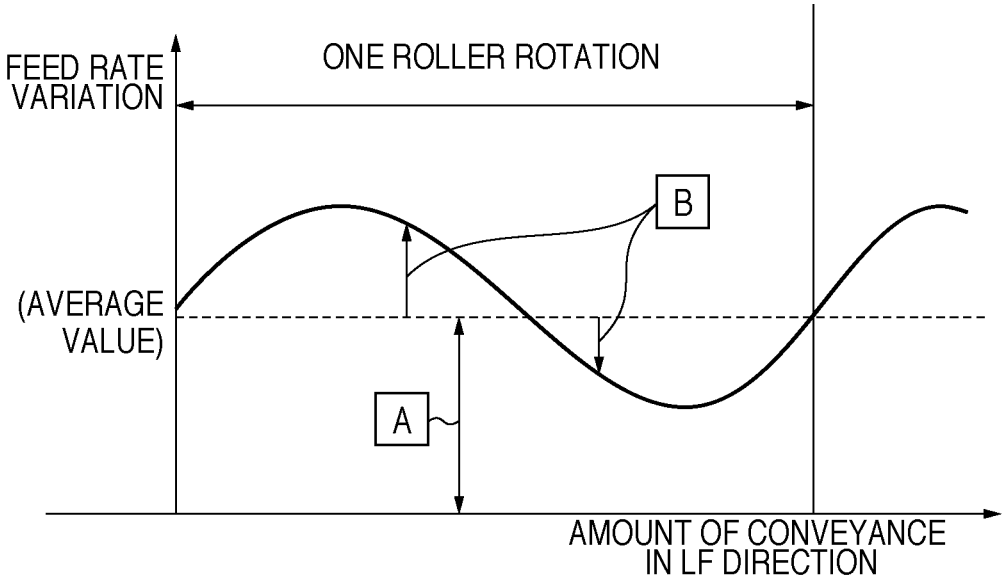
FIG. 5 is a diagram schematically showing variations in a feed rate in one cycle of a roller.

FIG. 5 is a diagram schematically showing variations in a feed rate in one cycle of a roller. In the figure, the ordinate represents the amount of feed rate variation and abscissa represents the amount of paper conveyance. As can be seen from the figure, the feed rate of paper can be expressed roughly by two components.

One of the components is a fixed component (A in FIG. 5) within one rotation of the roller. It is dependent on the paper type, individual apparatus, and environment. The other component is a variable component (B in FIG. 5) which has a period equal to one rotation of the roller. It is dependent on accuracy of the roller, flexure of the roller, and mounting of a roller support member. That is, the amount of paper conveyance can be approximated by the sum of the two components.

Incidentally, since the fixed component (A in FIG. 5) is dependent on operating environment, registration adjustment should be performed in the environment in which recording operation is actually performed. On the other hand, since the variable component (B in FIG. 5) is dependent on the individual apparatus, adjustment needs to be made only once before shipment or the like.

Figure 6A:
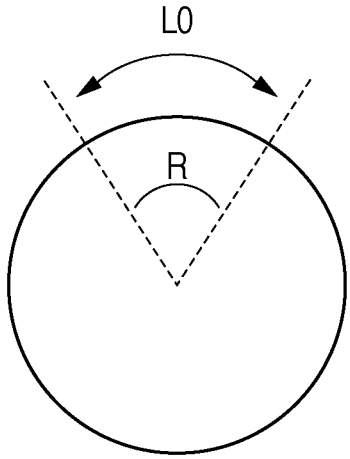
FIG. 6A is a schematic diagram showing differences in the amount of paper conveyance according to roller shape.
Figure 6B:
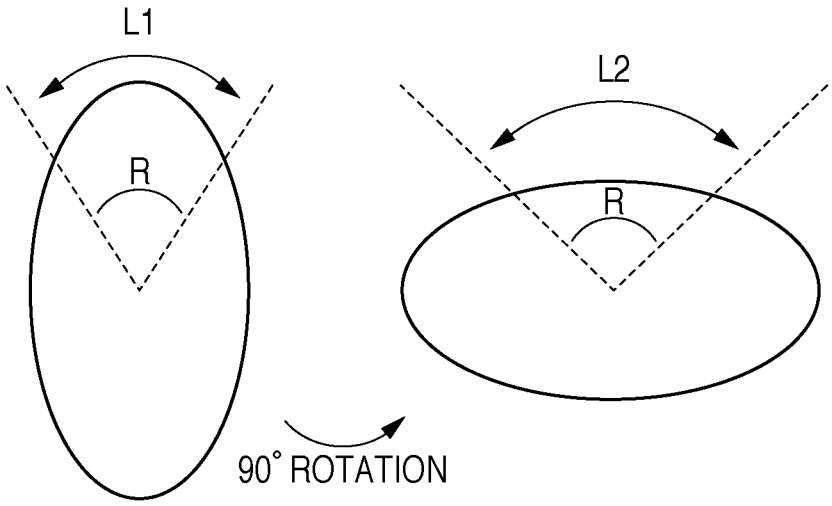
FIG. 6B is a schematic diagram showing differences in the amount of paper conveyance according to roller shape.

FIGS. 6A and 6B are schematic diagrams showing differences in the amount of paper conveyance according to roller cross-sectional shape.

If it is assumed that the rotation angle of a roller for paper conveyance is constant and if roller cross-sectional shape is a perfect circle, when the roller is rotated by an angle of R, the amount of conveyance is a constant L0, as shown in FIG. 6A. However, if the roller has an odd-shaped cross section, the amount of conveyance when the roller is rotated by an angle of R varies with the rotational position of the roller. For example, if the roller has an elliptic cross section, as shown in FIG. 6B, the paper is conveyed by L1 at a certain position, and conveyed by L2 at another position during the rotation of the roller. In that case, there is a relationship L1>L0>L2, and the variations in paper conveyance depend on the cycle of the roller. Moreover, these conveyance amounts L0, L1 and L2 are approximately equal to the length of the arc when the angle is "R".

Such variations in the amount of paper conveyance dependent on the cycle of the roller affect actual images. Variations in the amount of paper conveyance dependent on the cycle of the roller mean deflection in the landing position of ink droplets.

In FIGS. 6A and 6B generation of a conveyance amount displacement component within roller rotation by using the difference in cross-sectional shape of a roller that is a perfect circle and one that is oval-shaped was explained. Incidentally, it can be thought that the cause of the displacement component is not the cross-sectional shape of the roller, but is some other cause.

FIGS. 22A-22D show displacement of a conveyance amount originating from misalignment of the rotational axis of a conveyance roller.

Figure 22A:
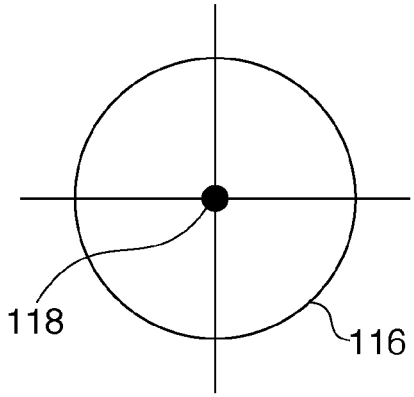
FIG. 22A is a drawing explaining rotation of a conveyance roller when there is no misalignment of a rotation axis of a conveyance roller.
Figure 22B:
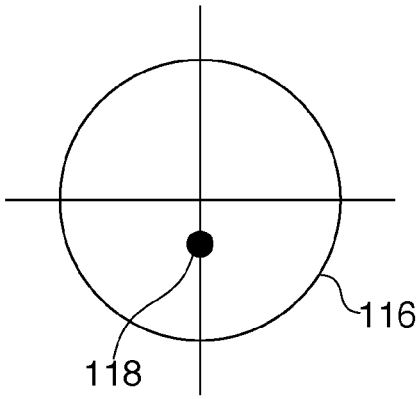
FIG. 22B is a drawing explaining rotation of a conveyance roller when there is no misalignment of a rotation axis of a conveyance roller.
Figure 22C:
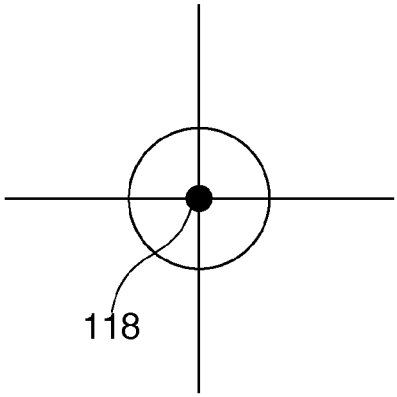
FIG. 22C is a drawing explaining rotation of a conveyance roller when there is a misalignment of a rotation axis of a conveyance roller.
Figure 22D:
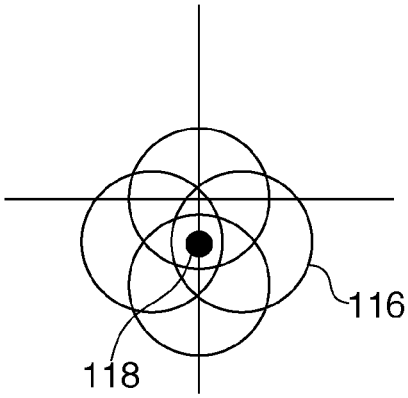
FIG. 22D is a drawing explaining rotation of a conveyance roller when there is a misalignment of a rotation axis of a conveyance roller.

FIG. 22A shows that the center of the diameter (central axis) of the roller 116 and the rotational axis 118 when the printing apparatus supports the roller 116 have the same shape. Further, FIG. 22B shows the center of the diameter of the roller 116 and the rotational axis of the roller 118 in the misaligned state. Moreover, the center of the diameter of the roller 116 is the point at which the dotted line intersects the plus sign in FIG. 22B. Further, frame format diagrams of the roller state when the roller 116 shown in FIGS. 2A, 2B is rotated around the rotational axis 118 are shown in FIGS. 22C, 22D, respectively. FIG. 22C is a frame format diagram of the roller 116 in FIG. 22A being rotated when the center of the diameter of roller 116 and the rotational axis are the same, and because they are the same, the cross-sectional view when looking at the roller from the side is the same as the outer shape of the roller even when the roller 116 is rotated. Further, FIG. 22D is a frame format diagram of the roller for which the center of the diameter and the rotational axis are not the same in FIG. 22B when it is rotated, and because they are not the same, the cross-sectional view when looking at the roller from the side changes as in FIG. 22D, along with the roller 116. As can be understood from FIG. 22D, when the center of the diameter of the roller and the rotational axis are misaligned, the conveyance amount when the roller is rotated over a predetermined angle, that is, the length of the arc corresponding to the predetermined angle, differs. For this reason, the conveyance amount of the printing medium differs depending on the rotational starting position of the roller.

Figure 23A:
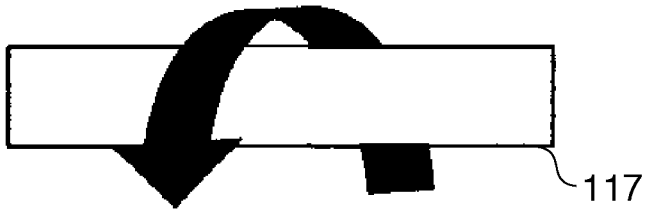
FIG. 23A is a drawing explaining rotation due to bending of a conveyance roller.
Figure 23B:
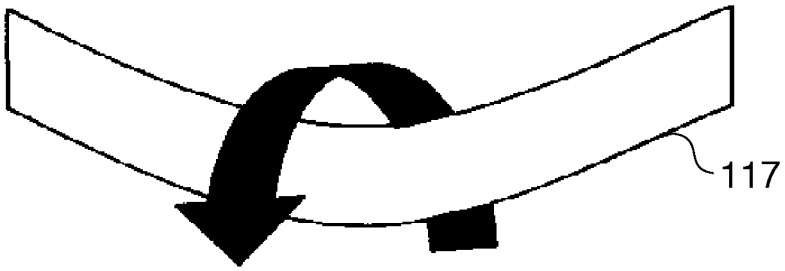
FIG. 23B is a drawing explaining rotation due to bending of a conveyance roller.

Further, bending of the conveyance roller can be given as another cause for generation of a displacement component. FIG. 23A shows a roller 177 with no bending, while FIG. 23B shows a roller 117 when bending occurs. As shown in FIG. 23B, long rollers have a possibility of flexing in response to bending. As shown in FIG. 23B, the conveyance amount of the printing medium can differ depending on the rotational starting position of the roller when bending occurs as well.

As explained above, several causes exist for differences in conveyance amount in response to the rotational starting position of the conveyance roller, that is, causes for differences in conveyance amount in a single revolution of the conveyance roller. Although there are several causes for the difference in conveyance amount, the problem occurring when an image is formed on a printing medium due to a differing conveyance amount is the same, and since it is possible to adapt to the shift in conveyance amount due to several causes in the present embodiment, the recording position misalignment in the conveyance direction can be reduced. Further, the application of the present invention is not limited to causes for the occurrence of the shift in conveyance amount explained above.

Figure 7A:
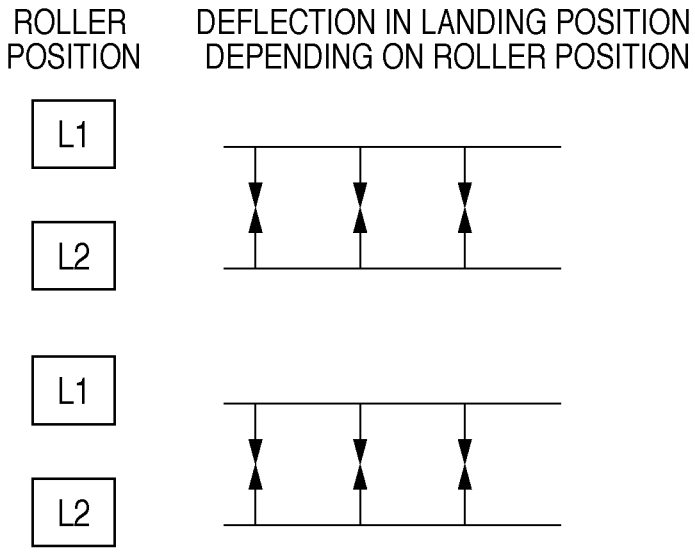
FIG. 7A is a diagram illustrating the effect of variations in the amount of paper conveyance on recording, where the variations are dependent on the cycle of the roller.
Figure 7B:
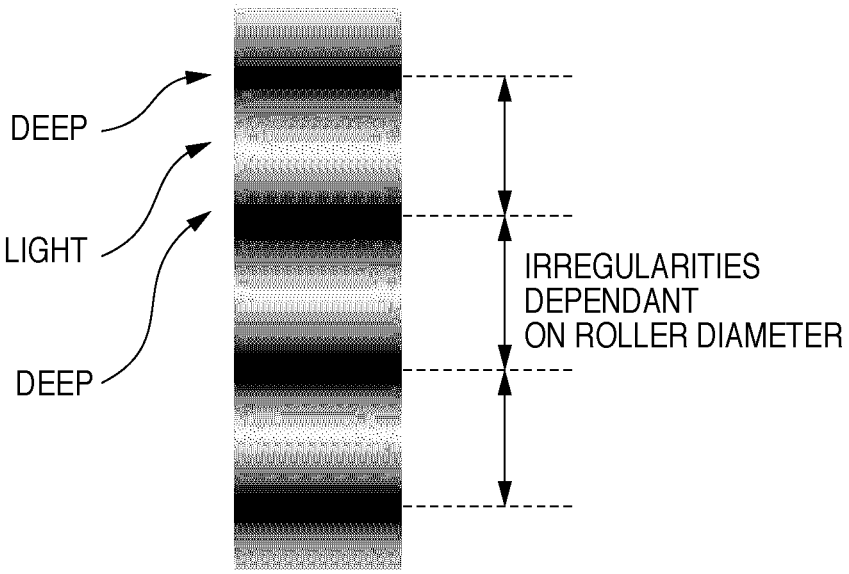
FIG. 7B is a diagram illustrating the effect of variations in the amount of paper conveyance on recording, where the variations are dependent on the cycle of the roller.

FIGS. 7A and 7B are diagrams illustrating the effect of variations in the amount of paper conveyance on recording, where the variations are dependent on the cycle of the roller.

When the roller is located in L1 in FIG. 6B, the paper is conveyed a larger distance than usual, and thus actual recording position is lower than desired recording position as shown in FIG. 7A. On the other hand, when the roller is located in L2 in FIG. 6B, the paper is conveyed a shorter distance than usual, and thus actual recording position is higher than ideal recording position as shown in FIG. 7A. Consequently, there are density differences such as shown in FIG. 7B even when a uniform image is recorded. Such irregularities stand out clearly on a uniform scene such as a background of a landscape, impairing high quality prints.

<Derivation of Fixed Component>

Normally, adjustment of the amount of paper conveyance unit adjustment of a fixed component (A in FIG. 5) dependent on the paper type, individual apparatus, and environment. In conventional techniques, deviation in the amount of conveyance is derived using adjustment patterns and used as a conveyance adjustment value. However, due to the effect of the variable component described above, the position at which the adjustment value for the fixed component is obtained can vary depending on the timing of registration adjustment operation.

Figure 8:
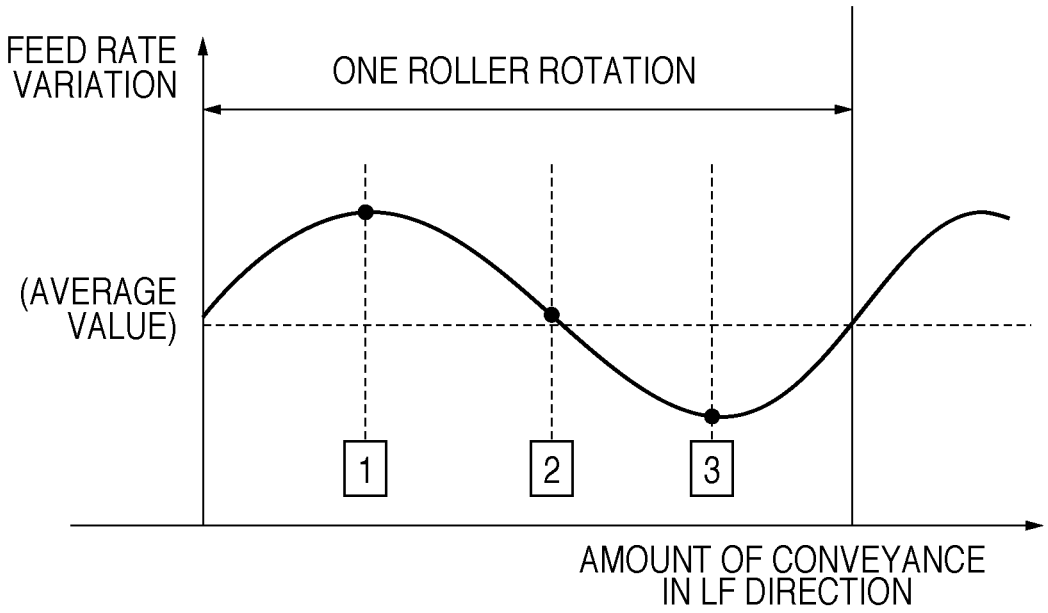
FIG. 8 is a diagram schematically showing changes in feed rate according to the position (phase) of a conveying roller.

FIG. 8 is a diagram schematically showing changes in feed rate according to the position (phase) of a conveying roller. If a registration adjustment is made at position (1) in FIG. 8, an adjustment value larger than the fixed component is obtained. If a registration adjustment is made at position (3), an adjustment value smaller than the fixed component is obtained. The adjustment value for the amount of conveyance can be derived almost properly corresponding to the fixed component if derived at position (2) in FIG. 8. However, it is generally difficult to find this position because the variable component depends on the accuracy of the roller, flexure of the roller, and mounting of a roller support member.

However, as described above, the variations in the amount of conveyance have a period equal to one rotation of the conveying roller. In particular, if the period of variation can be approximated by one period of a sine function, it can be seen from FIG. 5 that the amounts of variations at two points corresponding to ½ rotation of the conveying roller are equal in absolute value but opposite in sign. That is, an average amount of variations at the two points corresponding to ½ rotation of the conveying roller is equal to an average amount of conveyance per rotation of the conveying roller.

Thus, it can be seen that by controlling the rotation of the conveying roller based on the average amount of conveyance determined in this way, it is possible to reduce the effect of the fixed component (A in FIG. 5).

<Detection of Displacement in Conveyance using Reference Patterns (Outline)>

Next, description will be given of a method for detecting displacement in conveyance corresponding to positions of the conveying roller.

Figure 9:
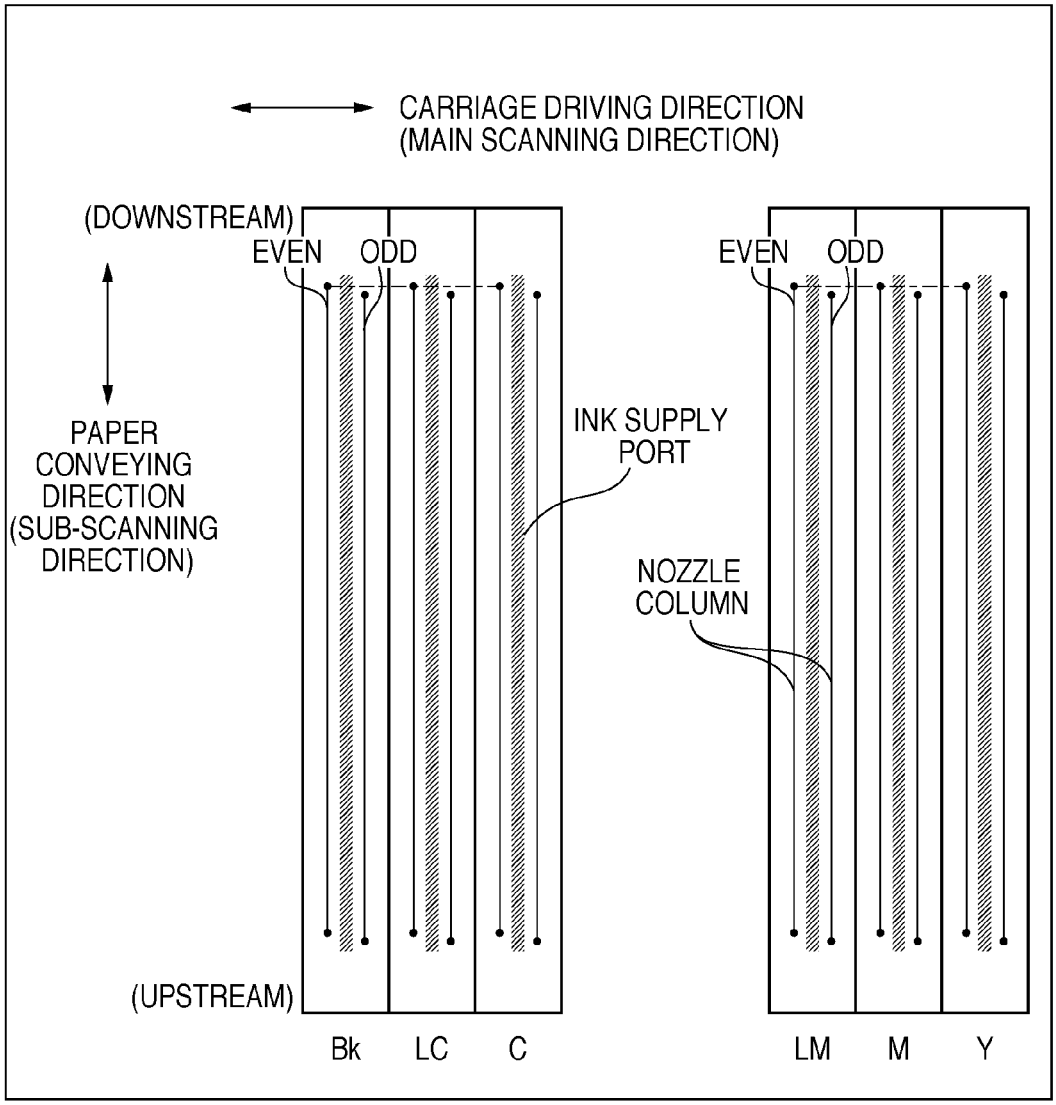
FIG. 9 is a diagram schematically showing a print head according to the first embodiment.

FIG. 9 is a diagram schematically showing the print head according to the first embodiment. Inks of six colors are used including black (Bk), light cyan (LC), cyan (C), light magenta (LM), magenta (M), and yellow (Y). Each of the six inks have an EVEN column and ODD column. That is, there are a total of 12 nozzle columns (=6 colors×2 columns) in the carriage driving direction.

Also, 640 nozzles are arranged in each nozzle column to provide a resolution of 600 dpi in the paper conveying direction. The EVEN and ODD nozzle columns of each color are placed being displaced 1/1200 inch in the paper conveying direction. Consequently, the resolution in the paper conveying direction is 1,200 dpi when both EVEN columns and ODD columns are used for recording.

In the following description, a print head with two nozzle columns per color as shown in FIG. 9 will be taken as an example. However, a print head in which each color consists of a single nozzle column can also be treated in a similar manner if even-numbered nozzles and odd-numbered nozzles are regarded as EVEN nozzle columns and ODD nozzle columns, respectively. Incidentally, the EVEN and ODD nozzle columns of Bk will be taken as an example in the following description, but the same is true to the other colors.

Figure 10A:
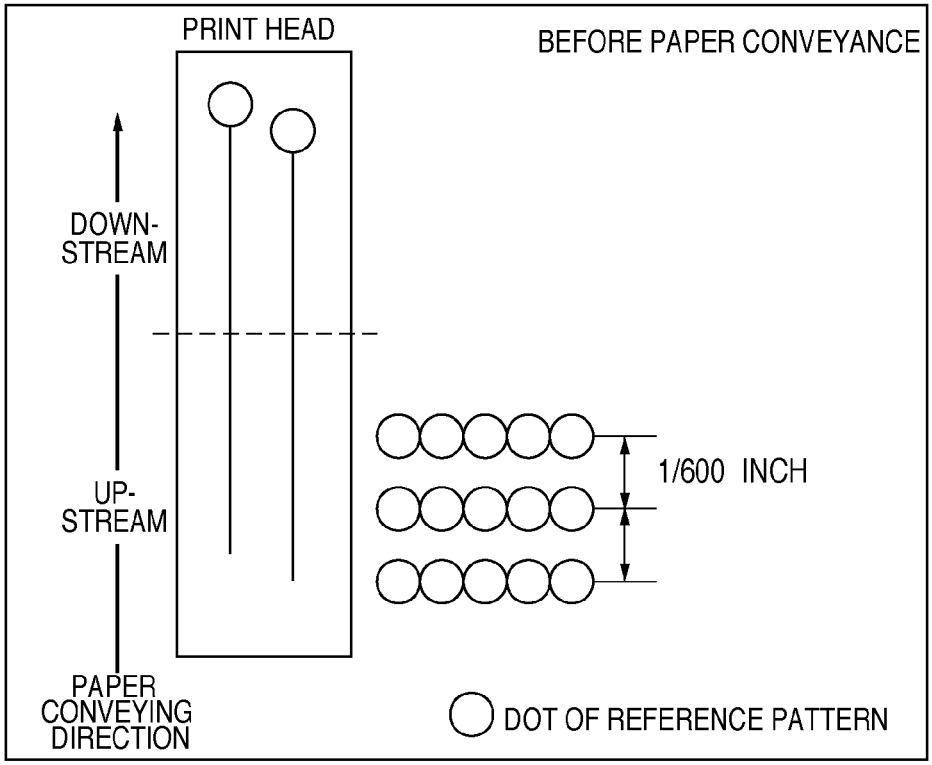
FIG. 10A is a diagram illustrating procedures for printing reference patterns.
Figure 10B:
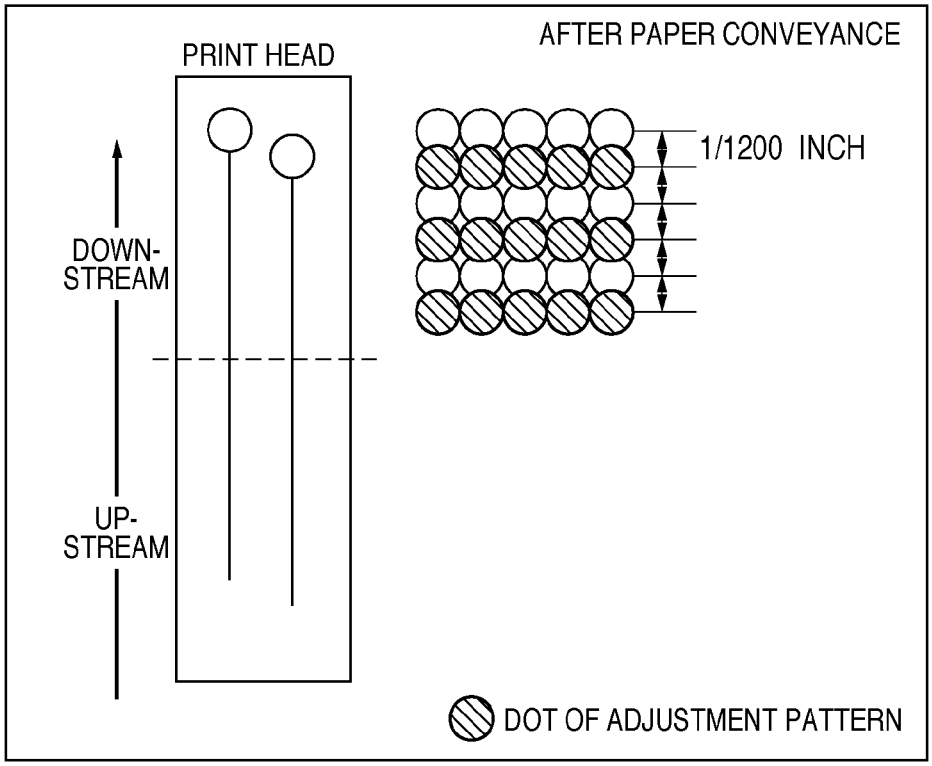
FIG. 10B is a diagram illustrating procedures for printing reference patterns.

FIGS. 10A and 10B are diagrams illustrating procedures for printing reference patterns. Incidentally, the nozzle columns will be divided into two parts in the paper conveying direction and the upstream half of the nozzles will be referred to as "upstream nozzles" and the downstream half of the nozzles will be referred to as "downstream nozzles."

First, reference patterns (first patterns) indicated by white dots in FIG. 10A are recorded using the upstream nozzles. Patterns recorded continuously in the direction orthogonal to the conveying direction are used as the reference patterns although details will be described later. Incidentally, any of the upstream nozzles are available for use, but it is assumed here for simplicity of explanation that all the upstream nozzles in the ODD column are used for recording.

Next, the paper is conveyed by a distance equal to half the length of the nozzle column. Feed resolution is a variable which depends on printer performance, but it is assumed here that the paper can be conveyed theoretically at a resolution of 9,600 dpi. That is, the paper is conveyed theoretically at 1/9600 inch per pulse. Under these conditions, to convey the paper by a distance equal to half the length of the nozzle column:

$$640*25.4/1200=13.55\ [\text{mm}],$$

a theoretical instruction pulse value (count) to be used is:

$$(640*25.4/1200)/25.4*9600=5120\ (\text{pulses})$$

After the paper conveyance, adjustment patterns (second patterns) indicated by black dots in FIG. 10B are recorded around the locations of the reference patterns (white dots) recorded earlier, using the downstream nozzles. It is assumed here for simplicity of explanation that all the downstream nozzles in the EVEN column are used for recording.

Figure 11A:
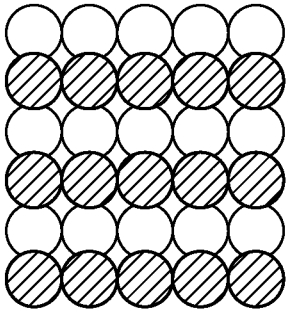
FIG. 11A is a schematic diagram of patterns printed one over another.
Figure 11B:
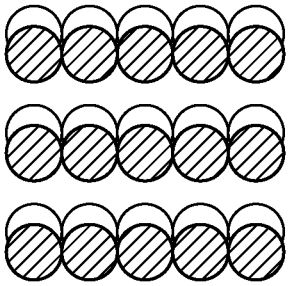
FIG. 11B is a schematic diagram of patterns printed one over another.

FIGS. 11A and 11B are schematic diagrams of patterns printed one over another. The white dots represent dots in the reference patterns formed on the medium (paper) using the upstream nozzles in the ODD column and the black dots represent dots in the adjustment patterns formed using the downstream nozzles in the EVEN column. Incidentally, the white dots and black dots are used for simplicity of explanation, and actually they are formed by the ink discharged from nozzles of the same color ink (Bk). They do not represent density.

If the amount by which the paper is conveyed based on an instruction pulse value after the white dots are recorded is equal to half the length of the nozzle column, a region with an area factor of nearly 100% is formed by printing the black dots over the white dots as shown in FIG. 11A. Hereinafter, the region formed by overprinting will be referred to as a "patch."

On the other hand, depending on the accuracy of the individual apparatus or changes in the printing medium caused by the environment and the like, the amount by which the paper is conveyed based on the instruction pulse value may deviate from the value equal to half the length of the nozzle column. In that case, even if black dots are overprinted, a patch with an area factor lower than 100% (50% at the minimum) will be formed as shown in FIG. 11B.

In forming a patch such as shown in FIG. 11B, suppose the area factor becomes 100% when the instruction pulse value is set, for example, at 5122 rather than 5120. In that case, it can be seen that for the combination of the given printer and printing medium, the correct instruction pulse value needed to feed the printing medium by 13.55 mm is 5122. That is, it is possible to derive the correct instruction pulse value by checking the area factors of the patches produced by varying the instruction pulse value for conveyance after white dots are recorded. The difference (+2 in this case) between the correct instruction pulse value (5122 in this case) and theoretical instruction pulse value (5120 in this case) corresponds to displacement in conveyance. A concrete method for constructing a patch using the above-described principle will be described below.

<Adjustment Patch Configuration Example 1>

Figure 12:
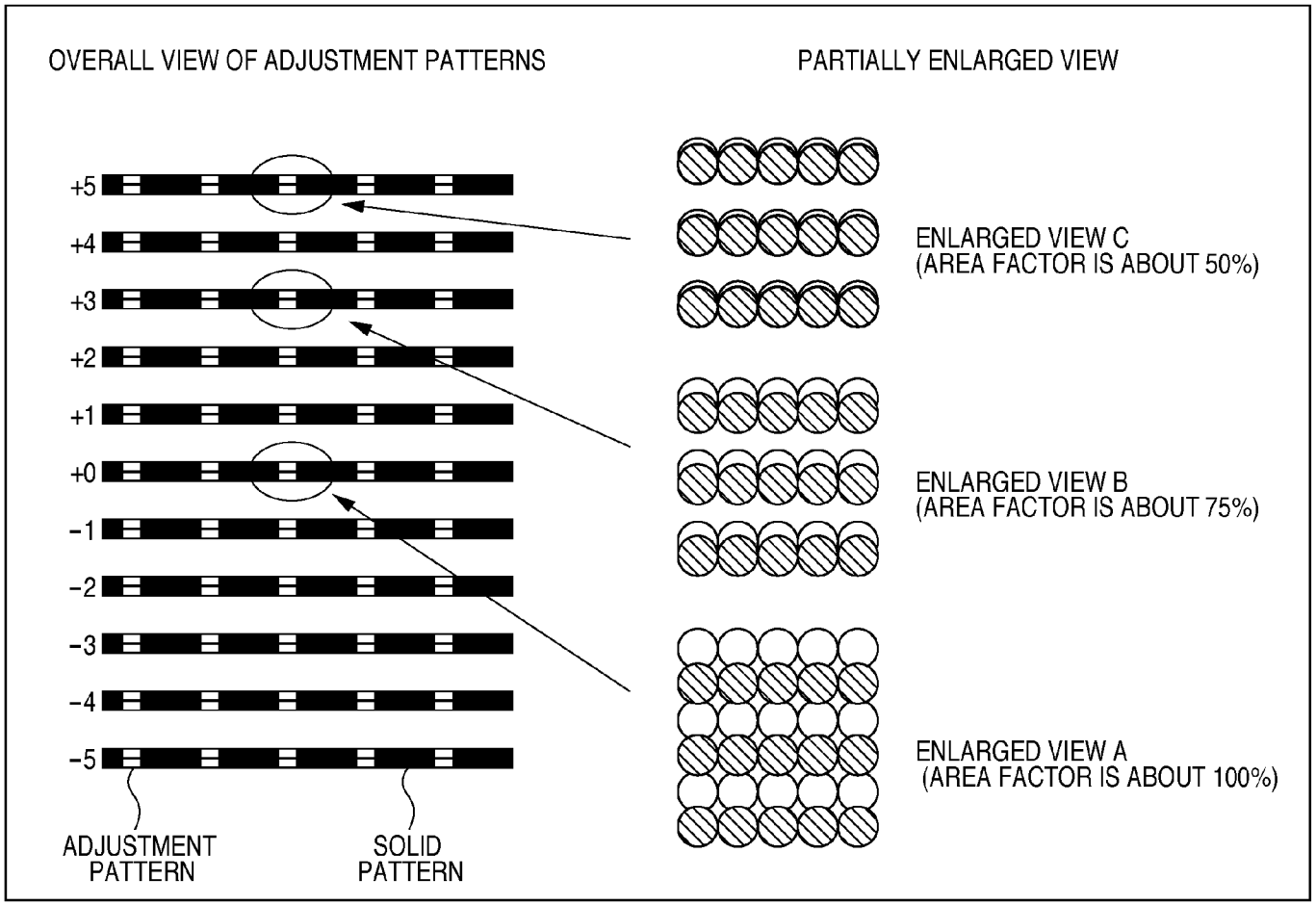
FIG. 12 is a diagram illustrating adjustment patches (configuration example 1)

FIG. 12 is a diagram illustrating adjustment patches (configuration example 1). Incidentally, with the adjustment patterns (second patterns) constituting the patches illustrated here, an adjustment range of the instruction pulse count is set at +/−5 pulses. Further more, to make it easier to make a selection by checking visually, five columns each of patches and solid patterns are arranged alternately in the main scanning direction.

Enlarged view A in FIG. 12 shows a patch whose pulse adjustment value is "0." After the reference patterns indicated by white dots are recorded, the paper is conveyed by the amount corresponding to an instruction pulse value of 5120 and the adjustment patterns indicated by the black dots are recorded. The resulting patch theoretically has an area factor of approximately 100%.

Enlarged view B in FIG. 12 shows a patch whose pulse adjustment value is "+3." After the reference patterns indicated by white dots are recorded, the paper is conveyed by the amount corresponding to an instruction pulse value of 5123 and the adjustment patterns indicated by the black dots are recorded. The resulting patch theoretically has an area factor of approximately 75%.

Enlarged view C in FIG. 12 shows a patch whose pulse adjustment value is "+5." After the reference patterns indicated by white dots are recorded, the paper is conveyed by the amount corresponding to an instruction pulse value of 5125 and the adjustment patterns indicated by the black dots are recorded. The resulting patch theoretically has an area factor of approximately 50%.

As described above, when recording a patch whose theoretical pulse adjustment value is "0," the area factor is approximately 100%. However, depending on the accuracy of the individual apparatus or changes in the printing medium caused by the environment and the like, the amount of paper conveyance corresponding to the instruction pulse value can differ from its theoretical value. That is, a patch area factor of approximately 100% may be produced by a pulse adjustment value other than "0."

Incidentally, the adjustment pattern of "+5" and adjustment pattern of "−5" in FIG. 12 causes displacement equivalent to one pixel dot. Thus, it can be seen that one out of 11 patterns always produces an area factor of approximately 100%. This makes it possible to determine a pulse adjustment value corresponding to an adjustment pattern with an area factor of approximately 100%. Incidentally, the pulse adjustment value corresponds to the amount of deviation in conveyance.

<Adjustment Patch Configuration Example 2>

With configuration example 1, it is necessary to change the instruction pulse value during recording of a pattern. This makes it necessary to arrange patches in the paper conveying direction. However, the arrangement in the paper conveying direction results in increased paper consumption. On the other hand, configuration example 2 allows paper feed adjustment to be made without changing the instruction pulse value.

Figure 13A:
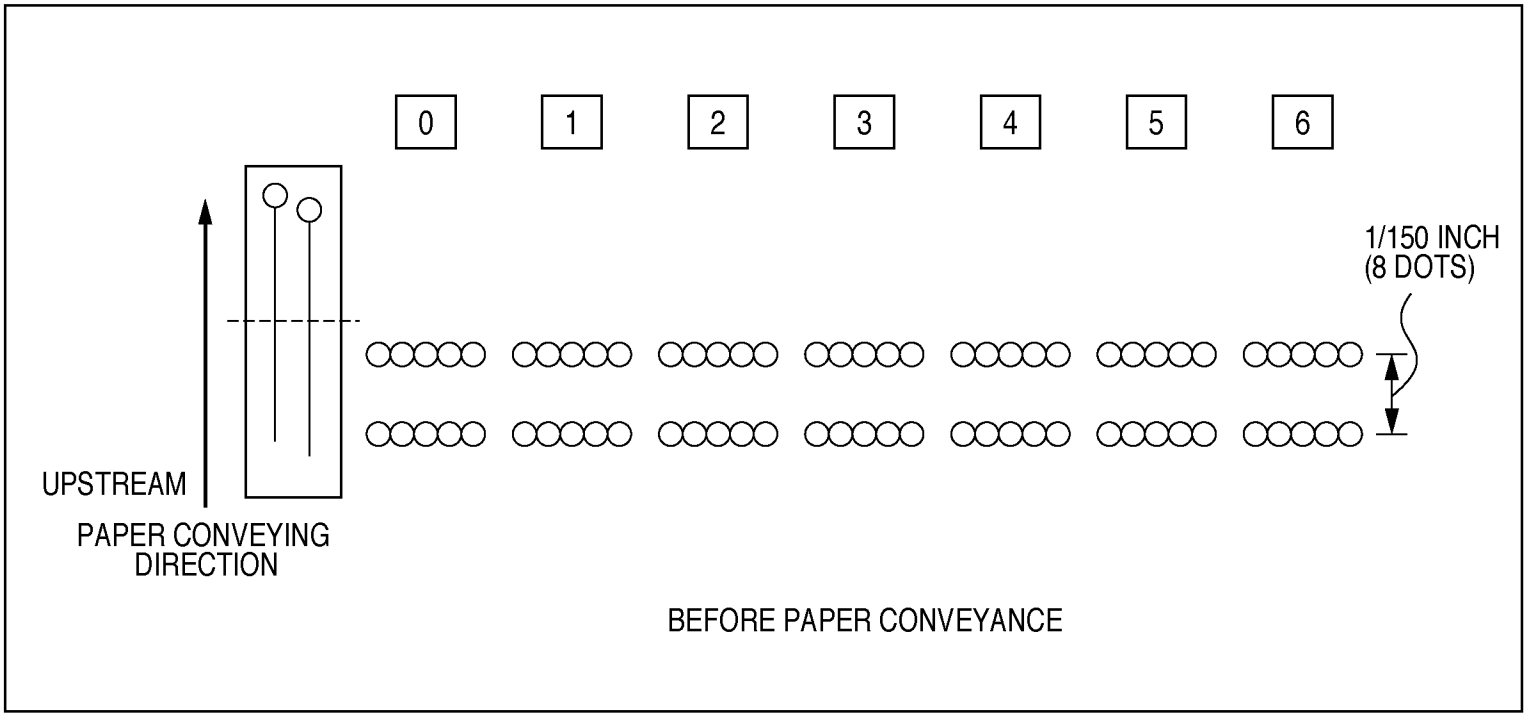
FIG. 13A is a diagram illustrating adjustment patches (configuration example 2)
Figure 13B:
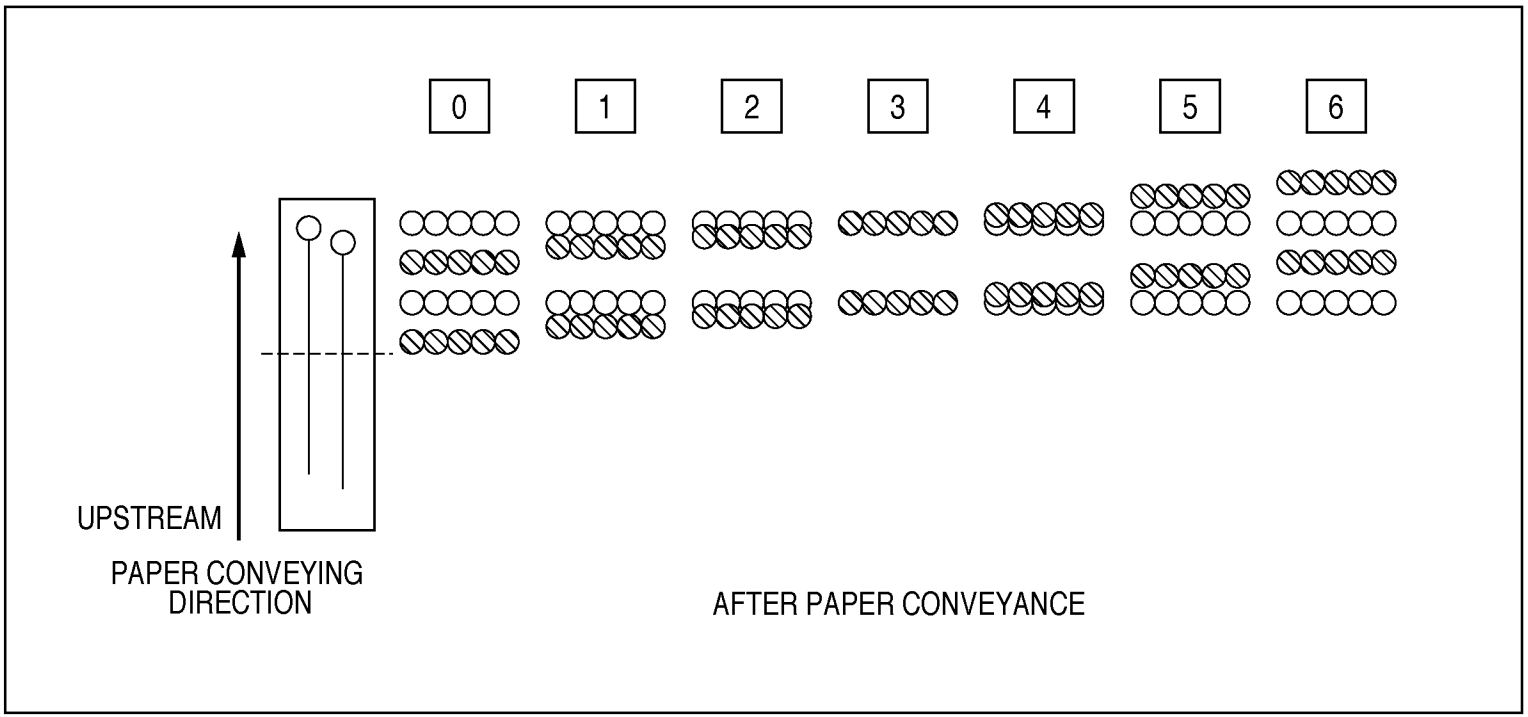
FIG. 13B is a diagram illustrating adjustment patches (configuration example 2)

FIGS. 13A and 13B are diagrams illustrating adjustment patches (configuration example 2). In the figures, seven patches are recorded in the main scanning direction.

First, reference patterns (first patterns) indicated by white dots in FIG. 13A are recorded using the upstream nozzles. Incidentally, any of the upstream nozzles are available for use, but it is assumed here for simplicity of explanation that all the upstream nozzles in the ODD column are used at intervals of four nozzles for recording. That is, the spacing between the two dot columns in the reference patterns shown in FIG. 13A is approximately 1/150 inch. Incidentally, the reference patterns arranged in the main scanning direction are identical to each other.

Next, to convey the paper by a distance equal to half the length of the nozzle column, the conveying roller is rotated with a theoretical instruction pulse value of 5120.

After the paper conveyance, adjustment patterns (second patterns) indicated by black dots in FIG. 13B are recorded around the locations of the reference patterns (white dots) recorded earlier, using the downstream nozzles. It is assumed here that the downstream nozzles in both the EVEN and ODD columns are used for recording. Specifically, by using, as a reference position, the 320th ODD-column nozzle position in the downstream direction from the upstream nozzles in the ODD column used to record the reference patterns, the adjustment patterns are recorded using the nozzles at seven locations displaced in the conveying direction in steps of one dot. In FIG. 13B, the nozzles used are located at −3, −2, −1, 0, +1, +2, and +3 positions displaced in steps of one dot from the reference position indicated by adjustment patterns of patches at position (3). That is, adjustment patterns displaced by −2, 0, or +2 are recorded using the nozzles in the ODD column and adjustment patterns displaced by −3, −1, +1, or +3 dots are recorded using the nozzles in the EVEN column.

Theoretically, the adjustment pattern at the reference position of (3) has the lowest patch area factor, which theoretically is approximately 12.5% (=100/8). However, depending on the accuracy of the individual apparatus or changes in the printing medium caused by the environment and the like, the amount of paper conveyance corresponding to the instruction pulse value can differ from its theoretical value. In that case, the patch area factor will exceed 12.5%.

Incidentally, the adjustment pattern of "−3" and adjustment pattern of "+3" in FIG. 13B cause displacement equivalent to seven pixel dots. Thus, it can be seen that one out of seven patches always produces an area factor of approximately 12.5%. There is almost a one-to-one correspondence between area factors and densities. Thus, it is possible to determine the amount of dot displacement by detecting the patch with the lowest density using the optical sensor 130. The amount of dot displacement corresponds to the amount of displacement in conveyance.

Figure 14:
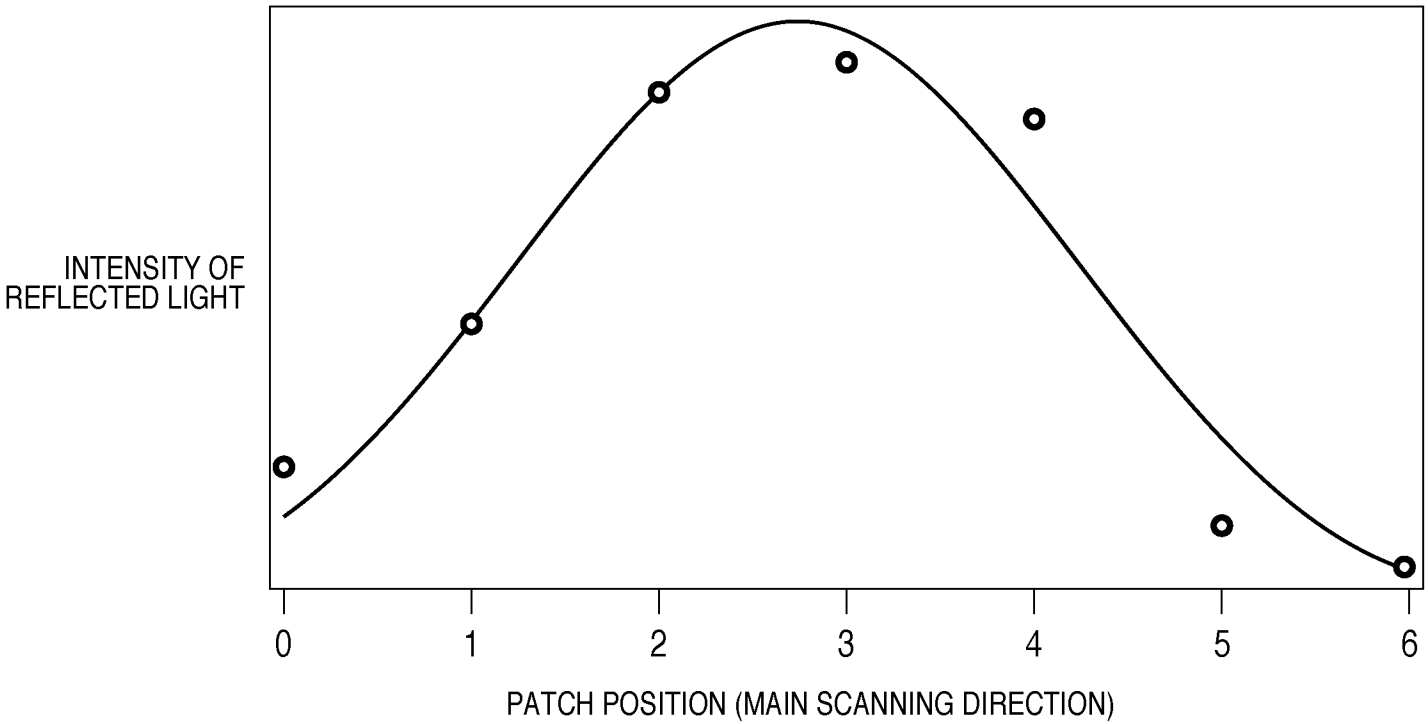
FIG. 14 is a diagram showing an example of detection of the adjustment patches (configuration example 2) shown in FIG. 13B.

FIG. 14 is a diagram showing an example of detection of the adjustment patches (configuration example 2) shown in FIG. 13B, where the ordinate represents intensity of irregularly reflected light. It can be seen that the stronger the reflected light, the lower the density. Thus, in FIG. 14, by using an adjustment value of "0," which is the adjustment value for the patch at position (3), it is possible to derive an adjustment value comparable to the nozzle resolution.

It is also preferable to use function approximation such as shown by the curve in FIG. 14. That is, a function is derived, for example, by applying the least-squares method to intensity values of reflected light for the seven patches. Then, by deriving and using paper feed adjustment position which corresponds to a maximum value of an approximated curve, it is possible to obtain an adjustment value with an accuracy higher than the nozzle resolution.

<Adjustment Patch Configuration Example 3>

Configuration example 3 is similar to configuration example 2, but the number of divisions of nozzles which record adjustment patterns is increased to further increase adjustment resolution. In the following example, the nozzles are divided into eight parts.

Figure 15A:
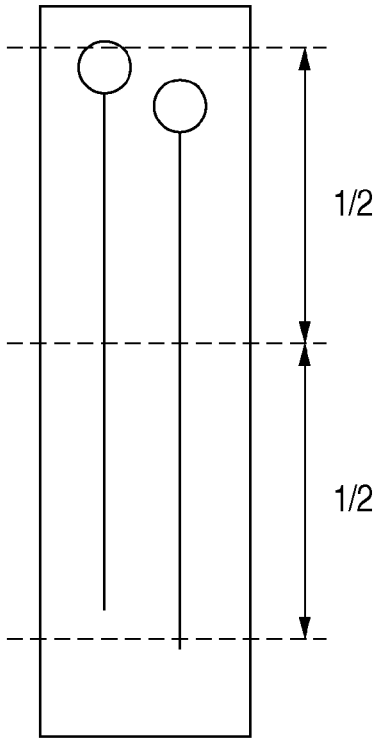
FIG. 15A is a diagram illustrating how nozzle columns are divided into two parts.
Figure 15B:
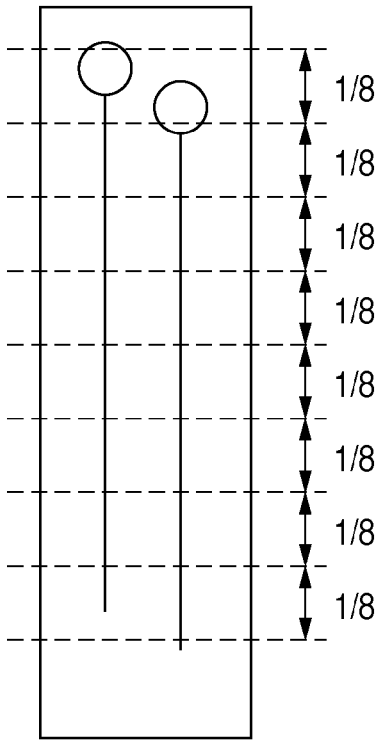
FIG. 15B is a diagram illustrating how nozzle columns are divided into eight parts.

FIGS. 15A and 15B are diagrams illustrating how nozzle columns are divided into two parts and eight parts, respectively. In the case of two-part split (FIG. 15A), reference patterns (first patterns) are recorded using the upstream ½ of the nozzles, the paper is conveyed by L×½, and then adjustment patterns (second patterns) are recorded using the downstream ½ of the nozzles. In the case of eight-part split (FIG. 15B), reference patterns (first patterns) are recorded using the upstream ⅛ of the nozzles, the paper is conveyed by L×⅞, and then adjustment patterns (second patterns) are recorded using the downstream ⅛ of the nozzles. That is, the amount of conveyance between the upstream pattern formation and downstream pattern formation is increased by 1.75 times.

Consequently, if the deviation in the amount of conveyance is constant on a per-sheet basis, white noise components are averaged and reduced, improving the S/N ratio. Thus, adjustment accuracy of the eight-part split patterns can be higher than that of the two-part split patterns. Suppose, there is a deviation equivalent to one pulse in relation to an instruction pulse value of 1280 (=5120/4). In the case of two-part split, the patches are subjected to a deviation equivalent to four pulses. In the case of eight-part split, the patches are subjected to a deviation equivalent to seven pulses. That is, the eight-part split has a larger impact on the patches.

Furthermore, in the case of eight-part split, the amount of conveyance per stroke is approximately 3.4 mm, making it possible to take 14 measurements per rotation of the roller. Thus, by using the average value of the 14 measurements as the amount of paper conveyance, it is possible to calculate the amount of paper conveyance more stably.

<Flow of Deriving Average Amount of Conveyance and Instruction Pulse Value>

Figure 16:
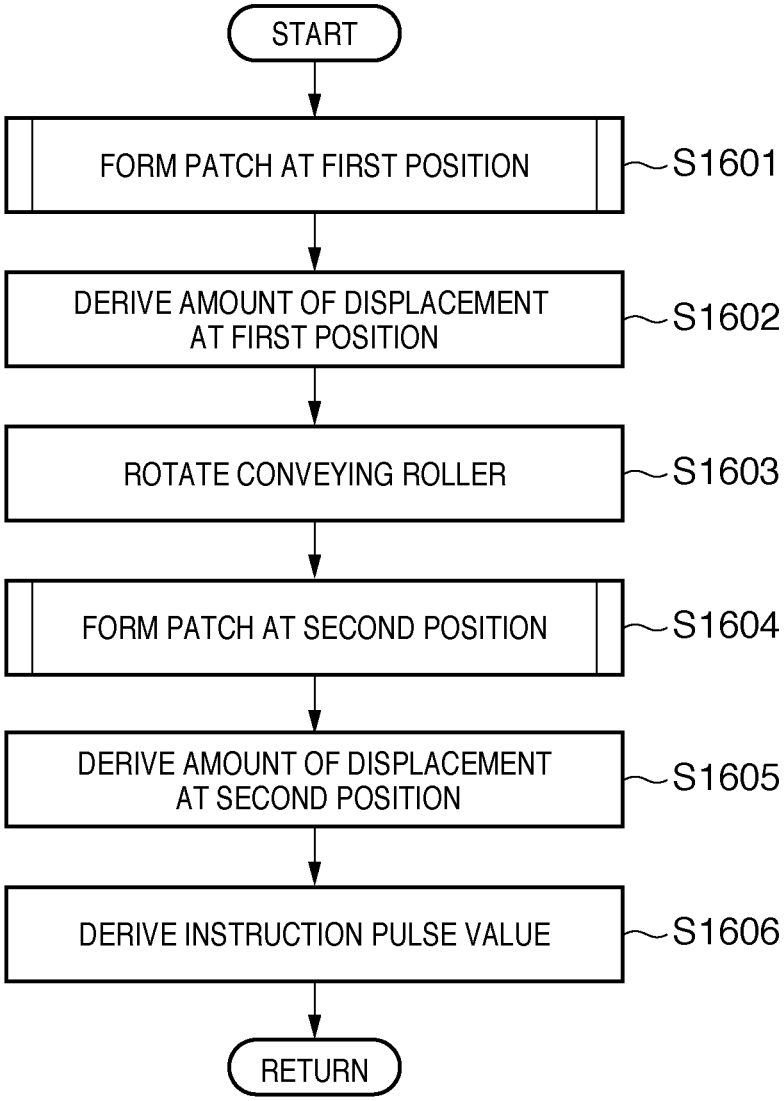
FIG. 16 is a flowchart showing procedures for deriving an average amount of conveyance and instruction pulse value during one rotation of a conveying roller.

FIG. 16 is a flowchart showing procedures for deriving an average amount of conveyance and instruction pulse value during one rotation of a conveying roller. Incidentally, although any of the three adjustment patch types described above may be selected freely, configuration example 2 will be cited here.

In Step S1601, an adjustment patch is formed at a first position (phase) of the conveying roller. That is, a reference pattern (first pattern) is formed using upstream nozzles and an adjustment pattern (second pattern) is formed using downstream nozzles.

In Step S1602, the amount of dot displacement at the first position (phase) is derived by measuring the adjustment patch formed in Step S1601. Details have been described in "Adjustment patch configuration example 2" and will be omitted here.

In Step S1603, the conveying roller is rotated by a half turn (180 degrees) from the position (phase) at which the reference pattern (first pattern) has been formed in Step S1601. Incidentally, the rotation angle of the conveying roller can be detected with much higher accuracy than the amount of dot displacement using an encoder (not shown) mounted on the conveying roller.

In Step S1604, an adjustment patch is formed at a second position (phase) of the conveying roller. That is, a reference pattern (first pattern) is formed using upstream nozzles and an adjustment pattern (second pattern) is formed using downstream nozzles.

In Step S1605, the amount of dot displacement at the second position (phase) is derived by measuring the adjustment patch formed in Step S1604. Details have been described in "Adjustment patch configuration example 2" and will be omitted here.

In Step S1606, an instruction pulse value corresponding to an average amount of conveyance is derived. That is, an average amount of displacement is calculated from the amount of dot displacement at the first position (phase) and amount of dot displacement at the second position (phase). Then, a correct instruction pulse value (5122 in this case) is calculated from a pulse adjustment value (e.g., +2) corresponding to the average amount of displacement and a theoretical instruction pulse value (e.g., 5120). The calculated correct instruction pulse value as the rotational amount of the conveyance roller during conveyance of the printing medium executed after print scanning in image formation is set, and the conveyance roller is driven based on the set pulse value. By driving the conveyance roller in this manner, the conveyance shift amount of a fixed component resulting from a full rotation of the conveyance roller is absorbed, enabling image formation with low density unevenness.

As described above, the average amount of displacement is derived from the amount of displacement at two positions (phases) of the conveying roller. The use of the average amount of displacement makes it possible to derive an almost constant correction value regardless of the timing of adjustment operation. By driving the conveying roller using the correction value thus derived, it is possible to reduce misregistration in the conveying direction of the printing medium.

In the above description, assuming that the variable component (B in FIG. 5) can be approximated by a sine curve with a period approximately equal to one rotation of the conveying roller, the average amount of conveyance has been derived from two positions 180 degrees out of phase with each other. When the variable component varies in a complicated manner, the average amount of conveyance can be derived with higher accuracy if it is derived from phases of more than two different points.

Also, the friction and amount of slippage between the conveyance roller and the printing medium differs depending on the type of printing medium. For this reason, by setting the amount of rotation of the roller for each type of printing medium, the average conveyance amount can be calculated with even higher accuracy.

(Second Embodiment)

A method for reducing the fixed component by deriving the average amount of conveyance has been described in the first embodiment. However, eccentricity of the conveying roller or the like can cause degradation of recorded images as shown in FIG. 7. Thus, in a second embodiment, description will be given of a method for controlling the conveying roller by detecting a variable component in each phase during one rotation of the conveying roller in addition to detection of the fixed component described in the first embodiment and deriving an adjustment value in each phase. Incidentally, equipment configuration and the like is the same as the first embodiment, and thus description thereof will be omitted.

<Variable Component Due to Eccentricity>

It is known, for example, that the variable component (B in FIG. 5) affects a recorded image formed by 4 p1 of ink droplets if its amplitude is larger than 30 μm. That part of the variable component which is attributable to roller deformation and roller flexure can be reduced to 30 μm or below with conventional machine accuracy. On the other hand, it is difficult to reduce that part of the variable component which is attributable to displacement in the mounting position of a roller support member to 30 μm or below.

Figure 17A:
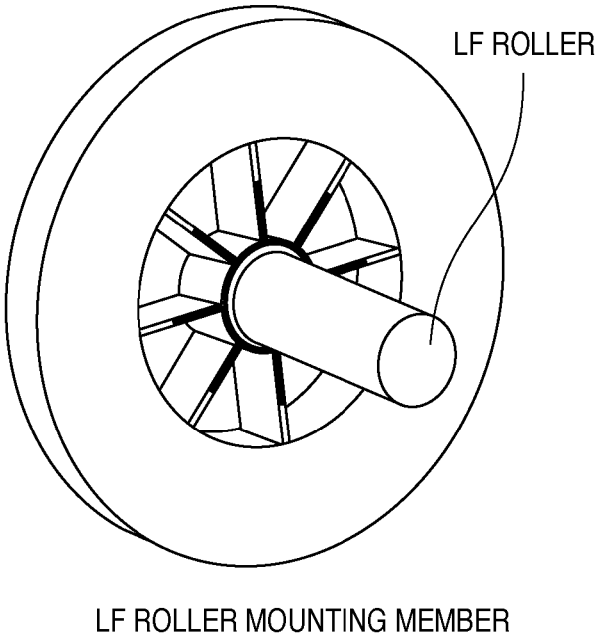
FIG. 17A is a diagram illustrating structures of a conveying roller and roller support member.
Figure 17B:
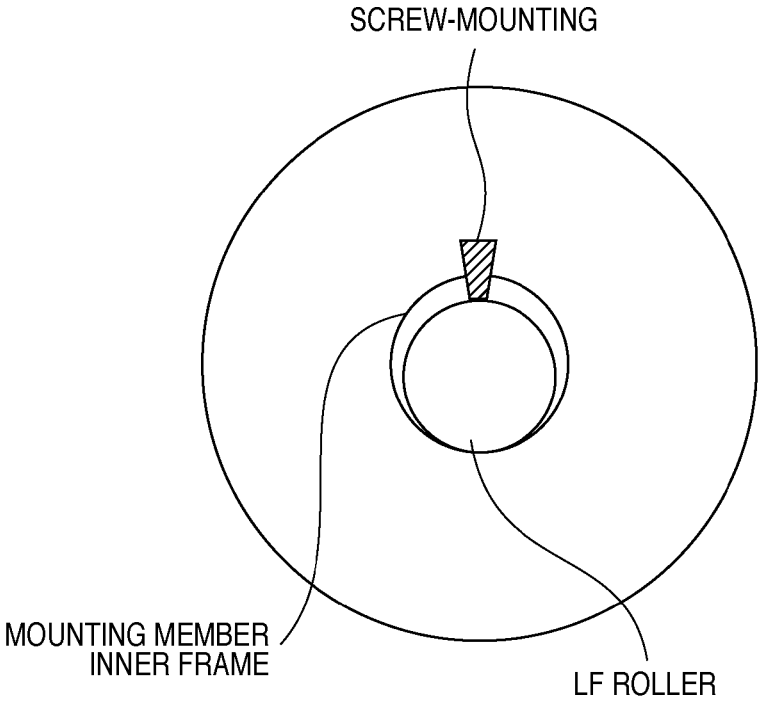
FIG. 17B is a diagram illustrating structures of a conveying roller and roller support member.

FIGS. 17A and 17B are diagrams illustrating structures of a conveying roller and roller support member. FIG. 17A is an external perspective view. There is no variable component when the central axis of the conveying roller coincides with the central axis of the roller support member. However, misalignment (eccentricity) can occur between the two axis depending on the tightening condition of mounting screws as shown in FIG. 17B. This will produce the variable component of conveyance.

<Adjustment Patch Configuration Example>

Figure 18:
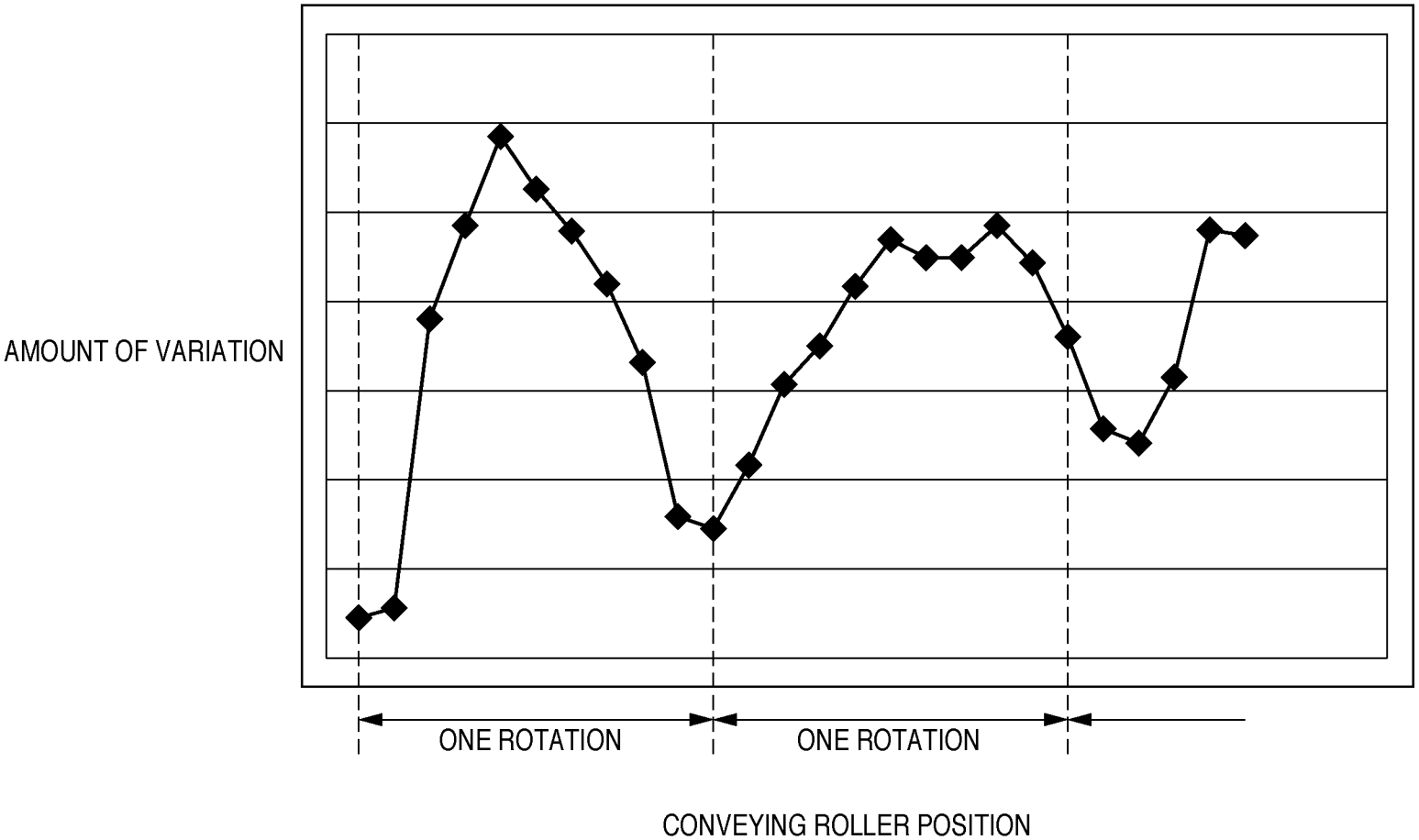
FIG. 18 is a diagram showing measured values feed rate for approximately 2.5 rotations of the conveying roller when there is eccentricity.

FIG. 18 is a diagram showing measured values of feed rate for approximately 2.5 rotations of the conveying roller when there is eccentricity. In the figure, the ordinate represents the amount of feed rate variation and abscissa represents the position of the conveying roller. It can be seen that there are peculiar variations in the feed rate with a period equal to one rotation of the conveying roller. However, variations in the feed rate include variable components other than sine functions. Consequently, although it is possible to measure the amount of variation using the nozzles in intervals A and B, since the amount of variation can fluctuate due to paper slippage and the like, it is likely that the S/N ratio (signal component/noise component) is low, making it difficult to measure eccentricity with high accuracy.

Incidentally, variable components other than sine functions are mainly attributable to paper slippage and the like as described above. It is known that the paper slippage and the like can be regarded as white noise (random noise). Therefore, with increases in the amount of conveyance, the variable components other than sine functions are averaged and noise is reduced relatively. That is, the S/N ratio is increased. However, simply increasing the amount of conveyance increases the amount (length) of the printing medium needed for registration adjustment. Thus, description will be given below of a method for reducing the variable components other than sine functions while curbing increases in consumption of the printing medium.

Figure 19:
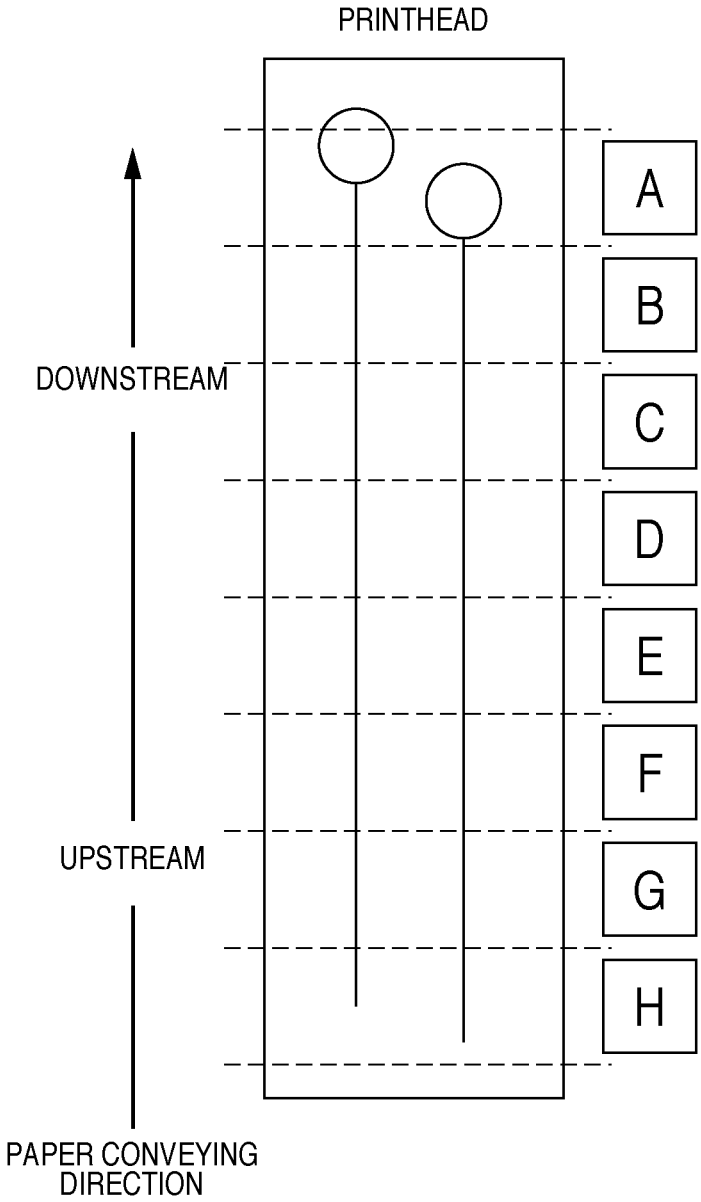
FIG. 19 is a diagram illustrating nozzle positions when a nozzle column is divided into A to H intervals (eight parts)

FIG. 19 is a diagram illustrating nozzle positions when a nozzle column is divided into A to H intervals (eight parts). When the conveying roller can be moved in steps of approximately ⅛ the length of the nozzle length at a time, the amount of displacement in conveyance can be detected in the same manner as adjustment patch configuration example 2 according to the first embodiment. That is, adjustment patches can be formed by forming reference patterns (first patterns) using the nozzles in interval A and forming adjustment patterns (second patterns) using the nozzles in interval B. However, the amount of conveyance between interval A and interval B is very small (approximately 3.4 mm). Thus, as described above, because of fluctuations in the amount of variation due to paper slippage and the like, it is difficult to detect only the amount of displacement attributable to eccentricity with accuracy.

Figure 20:
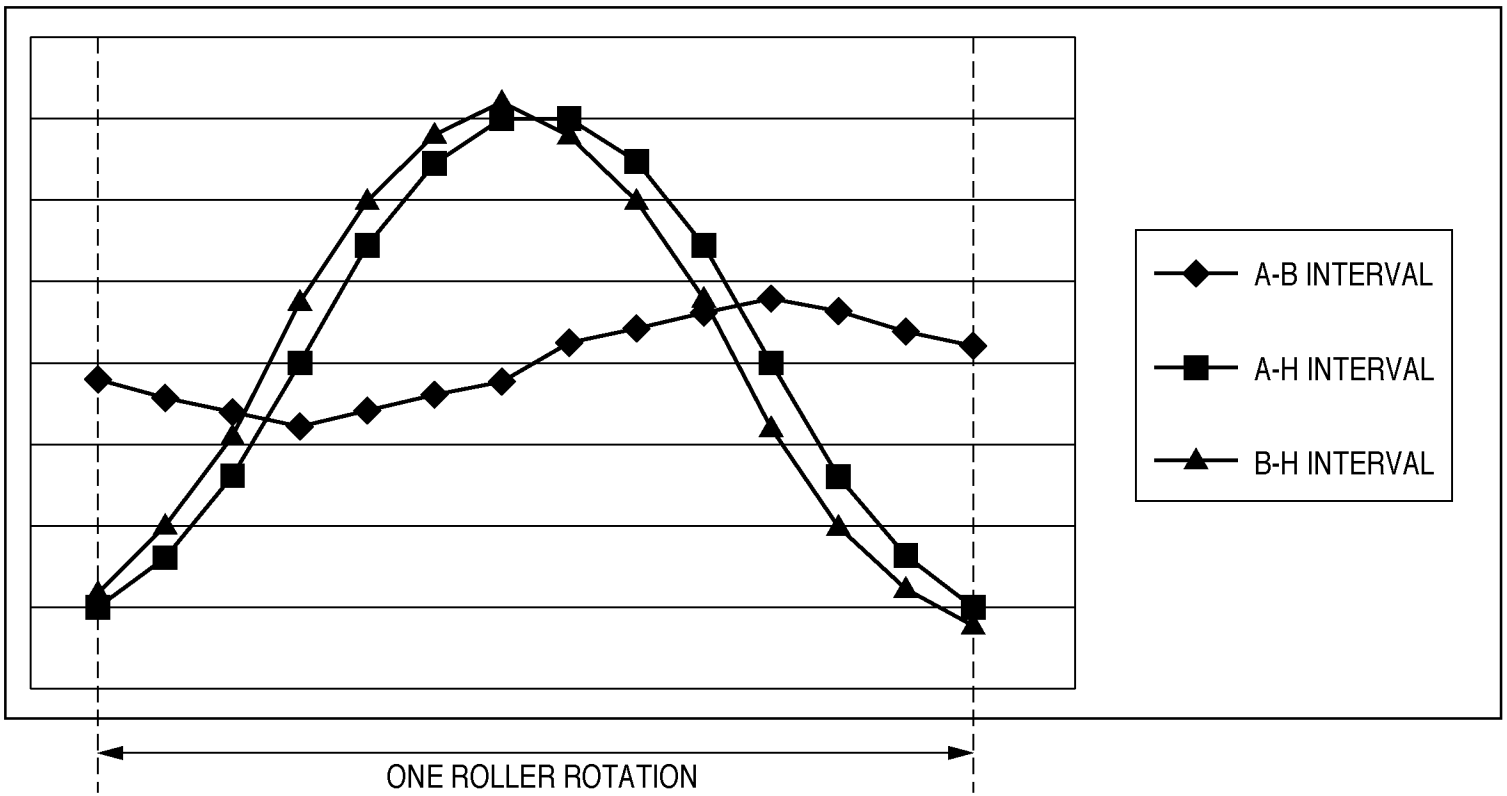

FIG. 20 is a diagram showing detected amounts of displacement when there is no fluctuation in the amount of variation due to paper slippage or the like. The figure shows measurement data of the amounts of displacement in an exemplary manner when adjustment patches are formed in A-B, A-H, and B-H intervals. It can be seen from the figure that the difference between measured values in the A-H interval and B-H interval should be equivalent in principle to measured values in the A-B interval.

Actually, the white noise component described above is superimposed on the measured values in the A-B, A-H, and B-H intervals. However, the amounts of conveyance in the A-B, A-H, and B-H intervals are approximately 3.4 mm, 23.7 mm, and 20.3 mm, respectively. Consequently, the noise level in the A-H interval is an average (integration) of seven measurements taken in the A-B interval while the noise level in the B-H interval is an average of six measurements taken in the A-B interval. Thus, it can be seen that the amount of displacement can be detected more accurately if the difference between the A-H interval and B-H interval is used as measurement data in the A-B interval instead of using data obtained by direct measurement in the A-B interval. This method makes it possible to derive accurate adjustment values for the instruction pulse value without increasing the amount of recording in the paper conveying direction.

<Modeling of Variable Components>

The method described above makes it possible obtain the amount of displacement for each stroke of paper conveyance (approximately 3.4 mm). Therefore, by repeating measurements 14 (=47/3.4) times, it is possible to obtain the amount of displacement in each phase during one rotation of the conveying roller, and thereby derive an adjustment value for the instruction pulse value.

Incidentally, as described above, it is known that the variable component attributable to displacement (eccentricity) in the mounting position of the roller support member is equal in period to one rotation of the roller and has the same effect in the positive and negative directions. Thus, the variable component can be modeled (approximated) using a sine function, making it possible to derive more accurate adjustment values for the instruction pulse value. Also, the sine function can be determined uniquely using four or more measurement points (amounts of displacement) during one rotation of the conveying roller, making it possible to speed up adjustment operation.

<Flow of Deriving Instruction Pulse Value According to Position (Phase) of Conveying Roller>

Figure 21:
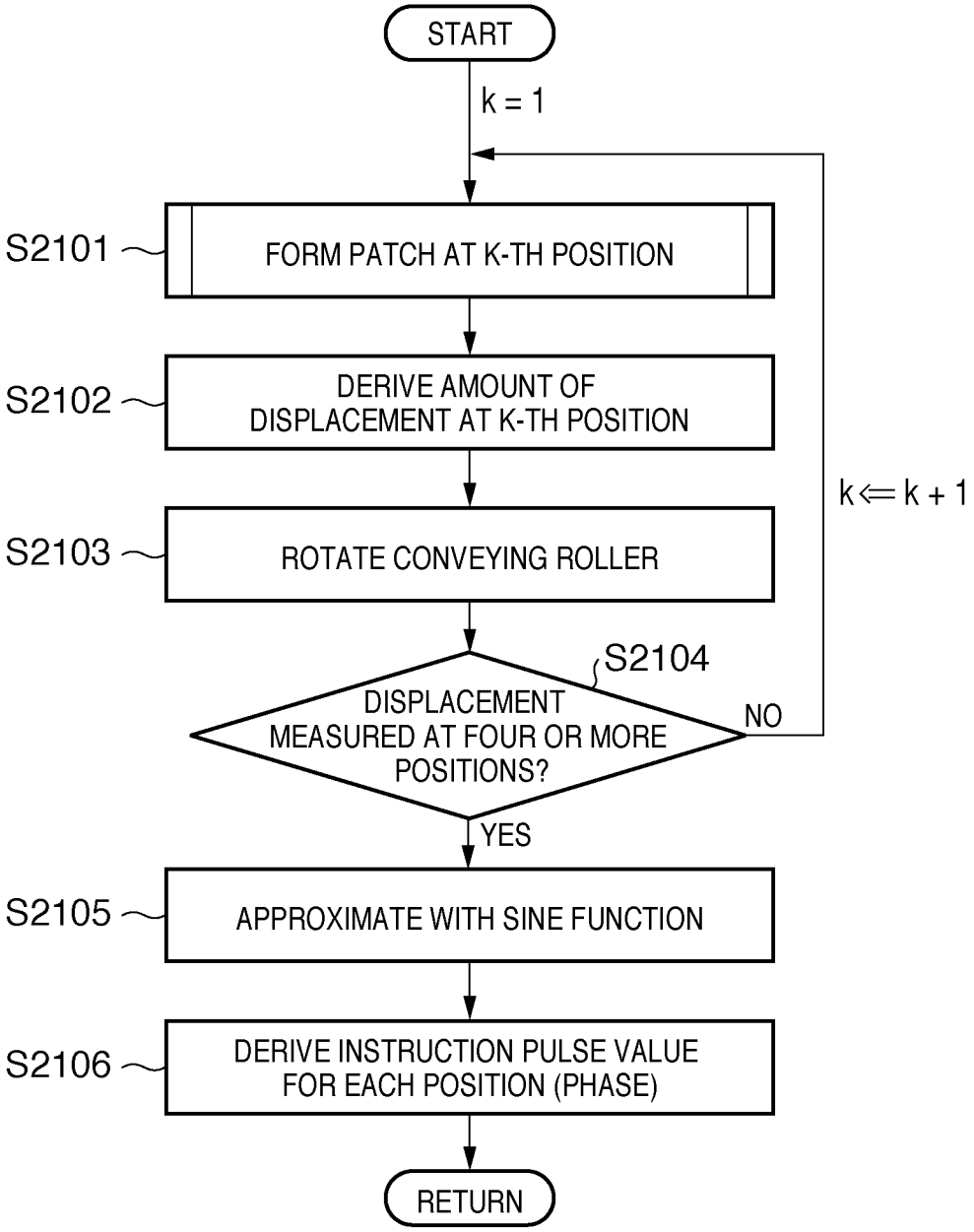
FIG. 21 is a flowchart showing procedures for deriving the amount of displacement and an instruction pulse value in each phase during one rotation of a conveying roller.

FIG. 21 is a flowchart showing procedures for deriving the amount of displacement and instruction pulse value in each phase during one rotation of a conveying roller.

In Step S2101, an adjustment patch is formed. That is, a reference pattern (first pattern) is formed using upstream nozzles and an adjustment pattern (second pattern) is formed using downstream nozzles.

In Step S2102, the amount of dot displacement at the position (phase) of formation of the adjustment patch is derived by measuring the adjustment patch formed in Step S2101. Details have been described in the first embodiment and will be omitted here.

In Step S2103, the conveying roller is rotated by a predetermined angle from the position (phase) at which the reference pattern (first pattern) has been formed in Step S2101. For example, it is rotated here by a ¼ turn (approximately 11.8 mm). Incidentally, the rotation angle of the conveying roller can be detected with much higher accuracy than the amount of dot displacement using an encoder (not shown) mounted on the conveying roller.

In Step S2104, it is checked whether amounts of displacement have been acquired at four or more positions (phases) during one rotation of the conveying roller. If yes, the flow goes to Step S2105. Otherwise flow returns to Step S2101.

In Step S2105, modeling (function approximation) is performed based on the amounts of displacement derived at the positions (phases) of the conveying roller in Steps S2101 to S2104. In the presence of eccentricity and the like, it is preferable to express the amounts of displacement in terms of a sine function with a period equal to one rotation of the conveying roller.

In Step S2106, a correct instruction pulse value for each phase of the conveying roller is derived using the function modeled in Step S2105. That is, the correct instruction pulse values for the phases of the conveying roller detected by the encoder are derived from the function.

By controlling the conveying roller based on the instruction pulse values thus derived, it is possible to reduce misregistration in the conveying direction of the printing medium. The second embodiment, in particular, can reduce displacement within one rotation of the conveying roller.

(Third Embodiment)

As a method for acquiring the conveyance amount for each phase angle of a rotation of the conveyance roller other than the embodiments mentioned above, the following method can also be used.

Figure 24A:
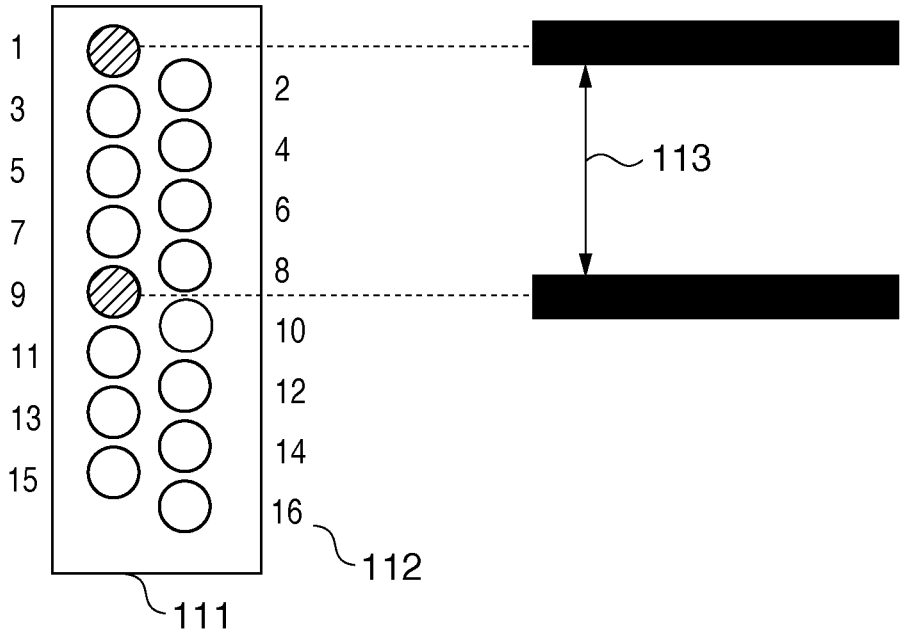
FIG. 24A is a drawing explaining a possible application of an acquisition method for a printing medium conveyance amount to the present invention.
Figure 24B:
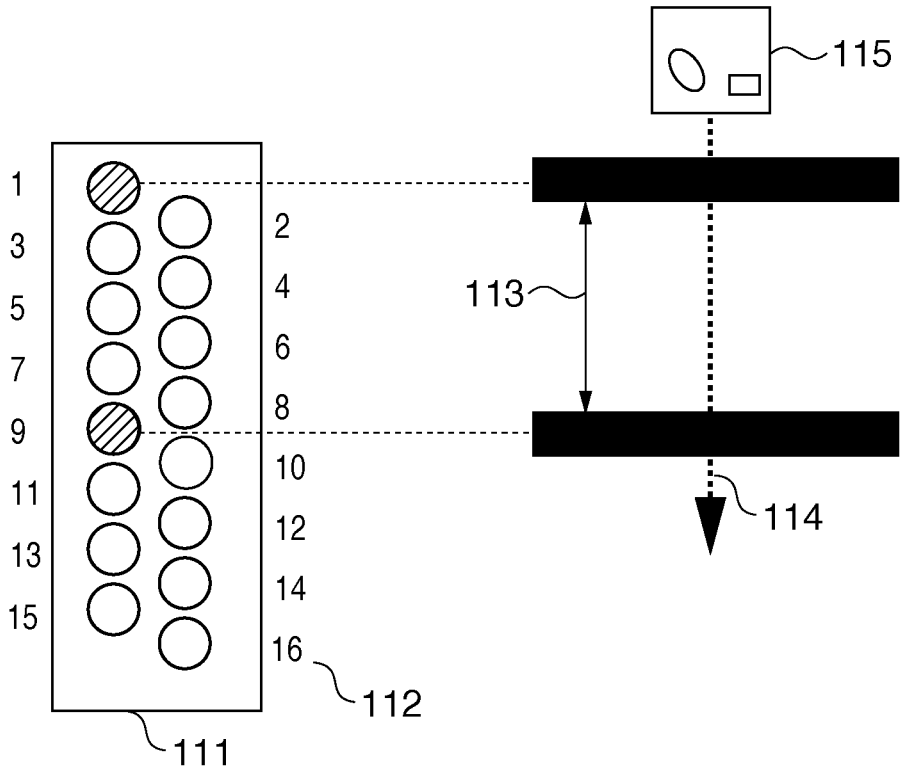
FIG. 24B is a drawing explaining a possible application of an acquisition method for a printing medium conveyance amount to the present invention.

FIG. 24A and FIG. 24B explain a method for acquiring a conveyance amount of a printing medium.

Moreover, because the nozzle-space distance and accuracy of the print head necessary for the method to acquire the conveyance amount of the present embodiment are regulated by the print head creation process, known values are used. In particular, the present method uses a nozzle-space distance to acquire an amount of misalignment of the conveyance amount.

First, as shown in FIG. 24A, by discharging ink from nozzle 1 and nozzle 9 of the nozzle array of the print head as the carriage scans, two straight lines are printed in the scanning direction. Moreover, the distance between the two straight lines formed on the printing medium is the same as the distance between nozzles 1 and 9.

Next, the distance between the two straight lines formed on the printing medium is measured using an optical sensor attached to the carriage. FIG. 24B shows a frame format diagram of detection. First, in order to make detection of the two printed straight lines by the optical sensor possible, the carriage is moved to position the optical sensor. Then, without moving the carriage, a conveyance operation is executed on the printing medium. The conveyance operation on the printing medium conveys the printing medium by rotating the conveyance rollers, and writes the rotation amount of the conveyance roller to memory from the encoder. Specifically, first, the encoder value when the optical sensor detects the straight line formed by nozzle 1 is written to memory as an initial value. Next, upon detection of the straight line formed by nozzle 9 by the optical sensory using conveyance operation of the printing medium, the encoder value at the time of detection is written to memory. The difference between these encoder values is the rotation amount of the conveyance roller required to convey the printing medium the distance from nozzle 1 to nozzle 9, and is the encoder pulse amount for driving the conveyance motor to rotate the conveyance roller. Because the nozzle-space distance of the print head is known, the distance between nozzle 1 and nozzle 9 can be determined. Also, the difference between the distance determined using the difference in encoder values and the distance between nozzle 1 and nozzle 9 is the shift in the conveyance amount. Here, by further taking the accuracy of the nozzle-space distance into consideration, the shift in conveyance amount can be determined with even higher accuracy.

By printing the two straight lines shown in FIG. 24B, and by measuring the distance between the two lines for one revolution of the conveyance roller, the conveyance amount for each roller position (conveyance shift amount) can be acquired. When the roller is a perfect circle, the amounts of printing medium conveyed for all roller positions are the same. However, as explained earlier, when the conveyance roller is not a perfect circle, the amounts of printing medium conveyed for all roller positions are not the same.

Moreover, while nozzles 1 through 9 are used in the explanation above, the numbers are not restricted, and any nozzles can be used. When selecting the nozzles to be used to print the straight line in the present embodiment, it is preferable to select nozzles with a distance similar to the conveyance amount during actual printing.

Also, when the light-emission unit (FIGS. 3, 31) of the optical sensor uses a visible-light LED, the output of the sensor decreases when the straight lines formed on the printing medium are detected by the optical sensor. When the output of the sensor in an area where nothing is printing on the printing medium is 100%, and the output in an area where something is printed is 0%, a change in output of approximately 25% is sufficient for determining the existence of a straight line. This is a situation in which the output is 75% that of an area where nothing is printed.

For this reason, the thickness of the printed line must be approximately ¼ the size of the sensor aperture unit. In other words, a sensor with an aperture unit that is approximately 4 times the printed straight line must be used. This means that when the line is formed with a width of 100 μm, the aperture unit must be 400 μm, and a sensor with even higher accuracy is necessary for length measurement.

In this way, by using the method described above, the shift in conveyance amount corresponding to a position of one revolution of a conveyance roller can be acquired. As in the first embodiment, by detecting the conveyance amount at two or more positions on the conveyance roller, the fixed components of the roller rotation such as type of printing medium and environment can be acquired, and a conveyance amount corresponding to the printing medium that decreases the effect of these fixed components can be acquired.

As shown above, the present invention has a characteristic not of depending on a method for acquiring a conveyance amount, but of realizing paper medium conveyance amount adjustment that reduces the effect of shift components due to a revolution of the conveyance roller. According to the present invention, an error component during acquisition of conveyance amount due to a conveyance roller shift is acquired by an operation of rotating a roller less than one revolution can be acquired, and execution of conveyance control which decreases an error component is possible.

Also, when rotating a conveyance roller over more than one revolution in acquiring a conveyance amount or a conveyance error, the amount of consumed printing medium and time for acquisition increase by the amount of the conveyance roller rotation. However, in the present invention, because a conveyance amount or conveyance error is acquired with a rotation amount of a rotation roller in less than one revolution, the consumed amount of printing medium and time for acquisition is reduced. Moreover, although a conveyance amount of the printing medium with respect to a predetermined rotation amount is acquired by a plurality of roller revolutions, even if rotation of a conveyance roller or a conveyance amount acquisition operation in less than one rotation is executed a plurality of times, the overall rotation amount of the conveyance roller is still less than one revolution. For this reason, the amount of printing medium required for the conveyance amount acquisition operation is shorter than the circumference of the conveyance roller, and can be reduced to significantly less than the amount of printing medium required for conventional conveyance amount correction.

Figure 25:
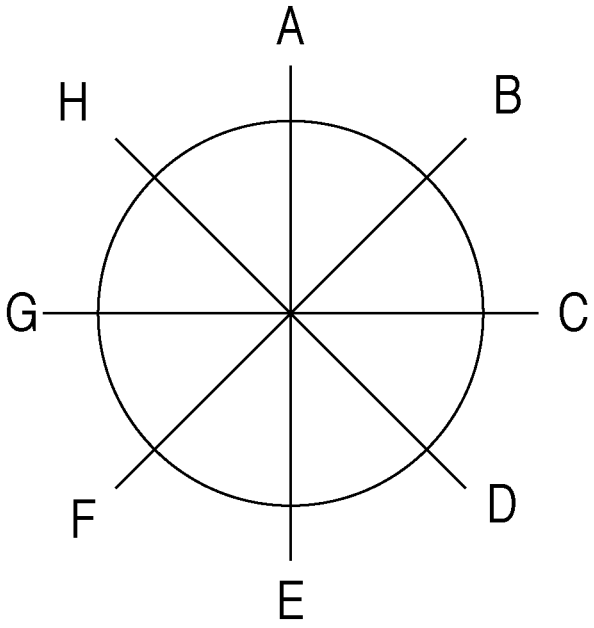
FIG. 25 is a drawing explaining a sampling point of a conveyance roller during conveyance amount acquisition.

Moreover, by rotating a conveyance roller by less than one revolution, regarding position determination of a plurality of sampling points when acquiring conveyance amount, it is desirable to divide the circumference of the conveyance roller by a constant number and acquire the positions. For example, if the conveyance amount is to be acquired with 8 sampling points, the conveyance amount is acquired at positions A-H as shown in FIG. 25. Here, for example, the conveyance amount of the medium in rotating the conveyance roller from point A to B (A-B space) is acquired. Similarly, the conveyance amount of the medium for B-C, C-D, . . . , H-A spaces are acquired. From the average of the plurality of acquired conveyance amounts, an approximation of the conveyance amount of the printing medium for ⅛ of a revolution of the conveyance roller can be calculated. Moreover, as a rotation amount of the conveyance roller during acquisition of the conveyance amount, rather than a rotation amount smaller than the rotation in A-B space, a predetermined rotation amount smaller than 45° from point A as a starting point can be used. In this case, each of the points A-H become rotational starting positions during conveyance amount acquisition, and the conveyance amount of the printing medium is detected by rotating the conveyance roller one predetermined rotation amount at a time from each rotation starting position. According to the present invention, even when executing a conveyance amount acquisition operation a plurality of times (plurality of points) in this way, the overall rotation of the conveyance roller is still less than one revolution.

Also, although a composition in which the conveyance amount is acquired using a plurality of points was described, the conveyance amount must be acquired using a minimum of 2 sampling points, and in this case it is preferable to acquire the conveyance amount using 2 points positioned 180° from each other on the roller. Normally, because the shape of the conveyance roller becomes close to an oval shape, the shift component can be reduced in most cases by acquiring the conveyance amount using 2 sampling points offset 180° from each other.

(Other Embodiments)

Embodiments of the present invention have been described in detail above, but the present invention may be applied either to a system consisting of two or more devices or to an apparatus consisting of a single device. For example, the present invention may take the form of an image output terminal of an information processing apparatus such as a computer installed either integrally or separately, a copying machine combined with a reader or the like, or a facsimile machine equipped with transmission and reception capabilities.

Incidentally, the present invention can also be achieved by a configuration in which a software program that implements the functions of the embodiments described above is supplied to a system or apparatus either directly or remotely and a computer in the system or apparatus reads out and executes the supplied program code. Thus, program code itself installed on the computer to implement functions and processes of the present invention on the computer also implements the present invention.

In that case, the program code may take any form including object code, programs executed by an interpreter, and script data supplied to an OS as long as it has program functions.

Recording media available for use to supply programs include, for example, floppy (registered trademark) disks, hard disks, optical disks (CD and DVD), magneto-optical disks, MO disks, magnetic tapes, and non-volatile memories.

The functions of the above embodiments may be implemented not only by the program read out and executed by the computer, but also by part or all of the actual processing executed, in accordance with instructions from the program, by an OS running on the computer.

Furthermore, the functions of the above embodiments may also be implemented by part or all of the actual processing executed by a CPU or the like contained in a function expansion board inserted in the computer or a function expansion unit connected to the computer if the processing is performed in accordance with instructions from the program code that has been read out of the storage medium and written into memory on the function expansion board or unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-056899, filed Mar. 2, 2006, and Japanese Patent Application No. 2007-047886, filed Feb. 27, 2007, which are hereby incorporated by reference herein in its entirety.

The invention claimed is:

1. A printing apparatus which prints an image on a printing medium using a print head which discharges ink, the printing apparatus comprising:

a conveyance unit having a roller configured to convey the printing medium in a first direction by rotating the roller;

a carriage on which the print head is mounted and configured to reciprocate along a second direction which is different from the first direction;

a detection unit having an optical sensor mounted on the carriage which is configured to read patterns formed on the printing medium with the print head;

an acquisition unit for acquiring relationships between a conveyance amount of the printing medium conveyed by the roller and a rotation amount of the roller by reading the patterns with the optical sensor at a plurality of rotational phases of the roller, wherein the acquisition unit is configured to acquire the relationships at N, N being greater than 2, rotational phases of the roller, each rotational phase being shifted by approximately 360°/N;

a setting unit for setting a rotation amount of the roller when printing an image on the printing medium with the print head based on the relationships acquired by the acquisition unit; and a control unit configured to control the apparatus such that when acquiring the relationships the print head prints a first patch, comprised of first and second patterns, the optical sensor reads the printed first patch, the roller rotates a predetermined amount to reach a next rotational phase, the print head prints a second patch, comprised of third and fourth patterns, and the optical sensor reads the printed second patch, wherein an overall rotation of the roller to acquire the relationships is less than one revolution.

2. A printing apparatus according to claim 1, wherein the setting unit is configured to set the rotation amount of the roller for each type of printing medium.

3. A printing apparatus according to claim 1, wherein the print head comprises a first line and a second line each having a plurality of printing elements, and wherein the print head forms the first patterns using the printing elements in the first line, the roller conveys the printing medium a small amount, the print head forms the second patterns using printing elements in the second line, and the optical sensor reads the first patterns and the second patterns formed by the printing elements in the first and second lines to detect a conveyance amount of the printing medium conveyed the small amount.

4. A printing apparatus according to claim 3, wherein the acquisition unit is configured to acquire a difference between a conveyance amount of the printing medium based on a rotation amount of the roller due to an instruction value and a detected conveyance amount of the printing medium, as a relationship at each of the rotational phases.

5. A printing apparatus according to claim 3, wherein the print head forms the third patterns using the printing elements in the first line, the roller conveys the printing medium another small amount, the print head forms the fourth patterns using printing elements in the second line, and the optical sensor reads the third patterns and the fourth patterns formed by the printing elements in the first and second lines to detect a conveyance amount of the printing medium conveyed the another small amount.

6. A method for controlling a printing apparatus which has a print head which discharges ink, a carriage on which the print head is mounted and which reciprocates, and a roller which conveys a printing medium, the printing apparatus prints an image on the printing medium using the print head, the method comprising:

a forming step of forming a patch, comprised of first and second patterns, on the printing medium with the print head;

a reading step of reading the patch formed on the printing medium by using an optical sensor mounted on the carriage;

a acquisition step of acquiring relationships between a conveyance amount of the printing medium conveyed by the roller and a rotation amount of the roller at a plurality of rotational phases of the roller in accordance with the reading in the reading step, wherein the relationships are acquired, in the acquisition step, at N, N being greater than 2, rotational phases of the roller, with each rotational phase being shifted by approximately 360°/N; and a setting step of setting a rotation amount of the roller when an image is printed on the printing medium with the print head based on the relationships acquired in the acquisition step, wherein an overall rotation of the roller to acquire the relationships is less than one revolution.

7. A printing method according to claim 6, further comprising:

a rotating step of rotating the roller a predetermined amount to reach a second rotational phase of the roller from the first rotational phase;

a second forming step of forming a second patch, comprised of third and fourth patterns, on the printing medium with the print head after the rotating step; and a second reading step of reading the second patch formed on the printing medium by using the optical sensor, wherein the acquisition step includes acquiring a relationship between a conveyance amount of the printing medium conveyed by the roller and a rotation amount of the roller at the second rotational phase of the roller in accordance with the reading in the second reading step.

8. A printing method according to claim 7, wherein the print head comprises a first line and a second line each having a plurality of printing elements, and wherein each of the first and the second forming steps comprise a step of forming patterns using printing elements in the first line, a step of conveying the printing medium a small amount, and a step of forming patterns using printing elements in the second line.

* * * * *